US009187105B2

(12) United States Patent
Tamaribuchi et al.

(10) Patent No.: US 9,187,105 B2
(45) Date of Patent: Nov. 17, 2015

(54) CONTROL SYSTEM, TERMINAL DEVICE FOR MAINTENANCE WORKER AND CONTROL DEVICE

(75) Inventors: Hiroyuki Tamaribuchi, Tokyo (JP); Yuto Kono, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 397 days.

(21) Appl. No.: 13/237,167

(22) Filed: Sep. 20, 2011

(65) Prior Publication Data

US 2012/0176217 A1 Jul. 12, 2012

(30) Foreign Application Priority Data

Jan. 11, 2011 (JP) ..... 2011-002943

(51) Int. Cl.

| | |
|---|---|
| ***B60R 25/00*** | (2013.01) |
| ***G05B 19/00*** | (2006.01) |
| ***G05B 23/00*** | (2006.01) |
| ***G06F 7/00*** | (2006.01) |
| ***G06F 7/04*** | (2006.01) |
| ***G08B 29/00*** | (2006.01) |
| ***G08C 19/00*** | (2006.01) |
| ***H04B 1/00*** | (2006.01) |
| ***H04B 3/00*** | (2006.01) |
| ***H04Q 1/00*** | (2006.01) |
| ***H04Q 9/00*** | (2006.01) |
| ***B61L 23/06*** | (2006.01) |

(52) U.S. Cl.

CPC ..... *B61L 23/06* (2013.01)

(58) Field of Classification Search

CPC ..... G07C 9/00103; G07C 9/00309; G07C 9/00182

USPC ..... 340/5.7

See application file for complete search history.

(56) References Cited

U.S. PATENT DOCUMENTS

| | | | | |
|---|---|---|---|---|
| 5,705,991 | A * | 1/1998 | Kniffin et al. | 340/5.28 |
| 5,942,985 | A * | 8/1999 | Chin | 340/5.61 |
| 8,548,391 | B2 * | 10/2013 | Zuckerman et al. | 455/73 |
| 2003/0025589 | A1 * | 2/2003 | Koike | 340/5.25 |
| 2007/0073457 | A1 * | 3/2007 | Lee | 701/29 |
| 2009/0140856 | A1 * | 6/2009 | George et al. | 340/542 |
| 2010/0013227 | A1 * | 1/2010 | Weitkamp | 290/44 |

FOREIGN PATENT DOCUMENTS

| | | |
|---|---|---|
| CN | 1629024 | 6/2005 |
| CN | 101486346 | 7/2009 |

(Continued)

OTHER PUBLICATIONS

Office Action issued Oct. 7, 2014 in Japanese application No. 2011-002943 (with English language translation).

(Continued)

*Primary Examiner* — Kerri McNally
*Assistant Examiner* — Anthony D Afrifa-Kyei
(74) *Attorney, Agent, or Firm* — Wenderoth, Lind & Ponack, L.L.P.

(57) ABSTRACT

A terminal device carried by a maintenance worker transmits, to a central control device, a request to maintain a first state in which a central control device controls a target device so that maintenance work is safely performed. The central control device transitions to a PIN lock state in which the first state is maintained, according to this request.

8 Claims, 23 Drawing Sheets

(56) References Cited

FOREIGN PATENT DOCUMENTS

| | | |
|---|---|---|
| JP | 06-332917 | 12/1994 |
| JP | 2005-029055 | 2/2005 |
| JP | 2006-260233 | 9/2006 |
| JP | 2008-001467 | 1/2008 |

OTHER PUBLICATIONS

Chinese Office Action issued Jun. 5, 2014 in corresponding Chinese Patent Application No. 201110282369.2 (with partial English language translation).

* cited by examiner

FIG. 6

| WORK ORDER NUMBER | PIN | SAFETY MEASURE 1 | SAFETY MEASURE 2 | SAFETY MEASURE 3 | ... |
|---|---|---|---|---|---|
| ... | ... | NOT YET | NA | NOT YET | ... |
| ..... | ..... | ..... | ..... | ..... | ..... |

CONTROL SYSTEM, TERMINAL DEVICE FOR MAINTENANCE WORKER AND CONTROL DEVICE

BACKGROUND OF THE INVENTION

1. Field of the Invention

The present invention relates to a control system for controlling a target device having an influence on safety of maintenance work, and a terminal device for maintenance worker and a control device included in the control system.

Priority is claimed on Japanese Patent Application No. 2011-002943, filed Jan. 11, 2011, the content of which is incorporated herein by reference.

2. Description of Related Art

In maintenance work, safety measures, such as a measure for prohibiting entry into a transportation facility during maintenance work for a transportation system or a measure for prohibiting use of an elevator during maintenance work for an elevator system, are executed using a remote manipulation in order to secure safety of workers (maintenance workers).

For example, in a rail transportation system, maintenance work for devices installed in a railroad line area that is a train traveling area may be executed. In this case, a measure for securing the safety of workers is executed by an ordering person in an operation control center. Such a measure includes, for example, stop of power supply to equipment to which electrical power is supplied, such as wires, protection from entry of a train (entry prohibition) using control of signaling equipment, and a deceleration instruction for an opposite railroad line.

Further, a manhole opening and closing switch provided in a manhole that is an entrance of a machine room of a passenger conveyor apparatus (e.g., an escalator) is disclosed in Japanese Patent Application, First Publication No. 2008-1467. When the open manhole is detected by the opening and closing switch, the passenger conveyor apparatus does not accept a remote manipulation. Accordingly, start-up by a remote manipulation can be suppressed.

However, the safety measure by a remote manipulation as described above may cause the workers to have anxiety and to be in danger.

For example, in the rail transportation system, the workers may be in danger due to erroneous situation recognition or manipulation mistake of an ordering person in an operation control center, even if workers are performing maintenance work inside the railroad line area. That is, the safety measure may not be executed or an executed safety measure may be released. Further, the worker at a maintenance worksite may not directly confirm an execution situation of the safety measure. In this case, the worker may feel anxious about whether the safety measure has been executed or not.

On the other hand, a worker confirming an execution situation of a safety measure or performing execution and release of the safety measure may be considered. This prevents the worker from feeling anxious and being in danger. However, for a certain work target, the worker may not be allowed to confirm the execution situation of the safety measure or to perform execution and release of the safety measure or it may be inappropriate for the worker to perform the execution and release of the safety measure.

For example, in a rail transportation system, a measure for stopping power supply to power supply equipment such as the above-described wires may be executed. For this measure, a worker needs to move to a substation, turn a breaker off, and perform a manipulation, for example, to apply a string indicating manipulation prohibition to the breaker. Further, a measure such as protection from vehicle entry (entry prohibition) or a deceleration instruction may be executed by controlling signaling equipment as described above. For this measure, the worker needs to move to a signaling control room, perform a manipulation for changing a signal from a manipulation panel, and perform a manipulation, for example, to apply a string indicating prohibition of release of a changing manipulation using the manipulation panel. Thus, the worker needs to move to a device control room (e.g. the substation or the signaling control room) and perform a manipulation for executing the safety measure. However, such a movement is limited to a case in which the device control room is in the vicinity of the worksite. Further, when the worker is not familiar with a manipulation for executing the safety measure, the worker may be in danger due to his or her manipulation mistake.

Further, according to a technique disclosed in Japanese Patent Application, First Publication No. 2008-1467, malfunction (start-up) caused by a remote manipulation can be suppressed as described above. Therefore, it is possible to prevent the worker from becoming anxious due to erroneous situation recognition or a manipulation mistake of a person performing the remote manipulation and to prevent the worker from being in danger.

However, in the technique described in Japanese Patent Application, First Publication No. 2008-1467, a physical switch is provided in the vicinity of the worksite to block a remote manipulation. In the rail transportation system, there are a plurality of worksites in a wide region. In such a case, in order for the worker to block the remote manipulation at the worksite by providing the switch for blocking a remote manipulation, a great number of switches must be provided. Accordingly, the cost for installing and maintaining the switches is expensive. Further, when the worker forgets to manipulate of the switch after work ends, the remote manipulation cannot be performed. Thus, it may be practically impossible to appropriately operate a remote manipulation by appropriately managing and operating a great number of switches.

Thus, for a system having a plurality of worksites in a wide region, it is not realistic to apply a method of providing the switches for blocking the remote manipulation in the vicinity of the worksites, such as the technique described in Japanese Patent Application, First Publication No. 2008-1467.

SUMMARY OF THE INVENTION

A control system according to a first aspect of the present invention includes a target device having an influence on safety of maintenance work; a control device for controlling the target device; and a terminal device (terminal device for maintenance worker) manipulated by a worker (maintenance worker) performing the maintenance work. The control device includes a control unit for controlling the target device to enter a first state (a maintenance-allowed state) in which the worker is allowed to safely perform the maintenance work; and a first communication unit (a communication unit of the control device) for performing communication. The terminal device includes a first input unit (a manipulation input unit of the terminal device for maintenance worker) for receiving an input manipulation by the worker; a request generation unit (a lock request generation unit) for generating a request directed to the control device; and a second communication unit (a communication unit of the maintenance worker terminal device) for performing communication. The request generation unit generates a lock request to request the control device to maintain the first state in response to the input manipulation when the control unit controls the target device to enter the first state. The second communication unit transmits the lock request. The first communication unit receives the lock request. The control unit transitions to a lock state in which the control unit controls the target device to maintain the first state, based on the lock request received by the first communication unit.

In the above-described control system, the control device may include a second input unit (a manipulation input unit of the control device) for receiving an input manipulation by a worker. In this case, the first communication unit transmits a work instruction indicating the content of the maintenance work to the second communication unit according to the input manipulation received by the second input unit. After receiving the work instruction, the second communication unit transmits first information indicating that the worker has confirmed the work instruction to the control unit according to the input manipulation received by the first input unit. The control unit controls the target device to enter the first state based on the first information transmitted from the second communication unit.

In the above-described control system, when the control unit controls the target device to enter the first state, the first communication unit may transmit second information indicating the target device has entered the first state, to the second communication unit. In this case, after receiving the second information, the second communication unit transmits the lock request to the control device according to the input manipulation received by the first input unit. The control unit transitions to the lock state based on the lock request transmitted from the terminal device.

In the above-described control system, the first input unit may receive an input manipulation for lock request including personal identification code for identifying the worker. In this case, the second communication unit transmits the lock request including the personal identification code. The control unit transitions to the lock state when judging that the personal identification code included in the lock request is coincident with a previously registered personal identification code.

In the above-described control system, the first communication unit and the second communication unit may perform wireless communication.

In the above-described control system, after receiving the lock request, the second communication unit may transmit a release request to request release of the lock state according to the input manipulation received by the first input unit. In this case, the control unit releases the lock state based on the release request.

In the above-described control system, the first input unit may receive an input manipulation for a release request including an input of a personal identification code for identifying the worker. In this case, the second communication unit transmits the release request including the personal identification code to the control unit. The control unit releases the lock state when judging that the personal identification code included in the release request is coincident with a previously registered personal identification code.

In the above-described control system, the control device may include a second input unit for receiving an input manipulation by the worker. The control unit releases the lock state based on the input manipulation received by the second input unit.

A terminal device according to a second aspect of the present invention includes a communication unit for receiving information of a control device for controlling a target device having an influence on safety of maintenance work; and an input unit (manipulation input unit) for receiving an input manipulation. The communication unit receives information indicating that the control device controls the target device to enter a first state in which the maintenance work is safely performed, and transmits a lock request to the control device to request the control device to maintain the first state in response to the input manipulation received by the input unit, after receiving the information.

In the above-described terminal device, after receiving the lock request, the communication unit may transmit a release request to the control device to request release of the lock state according to the input manipulation received by the input unit.

A control device according to a third aspect of the present invention includes a control unit for controlling a target device having an influence on safety of maintenance work to enter a first state in which the maintenance work is safely performed; a communication unit for receiving a lock request to request to maintain the first state, and when controlling the target device to enter the first state. The control unit transitions to a lock state in which the control unit controls the target device to maintain the first state when the communication unit receives the lock request.

In the above-described control device, the communication unit may receive a release request to request release of the lock state. In this case, from the lock state, the control unit releases the lock state based on the release request when the communication unit receives the release request.

An object of the present invention is to provide a control system, a terminal device and a control device capable of reducing possibility of a worker being in danger without giving anxiety to the worker even in a system having a plurality of worksites in a wide region.

BRIEF DESCRIPTION OF THE DRAWINGS

FIG. 6 is an illustrative diagram showing a data structure of safety measure management data stored in a storage unit of the embodiment.

DETAILED DESCRIPTION OF THE INVENTION

Hereinafter, an embodiment of the present invention will be described with reference to the accompanying drawings.

Figure 1:
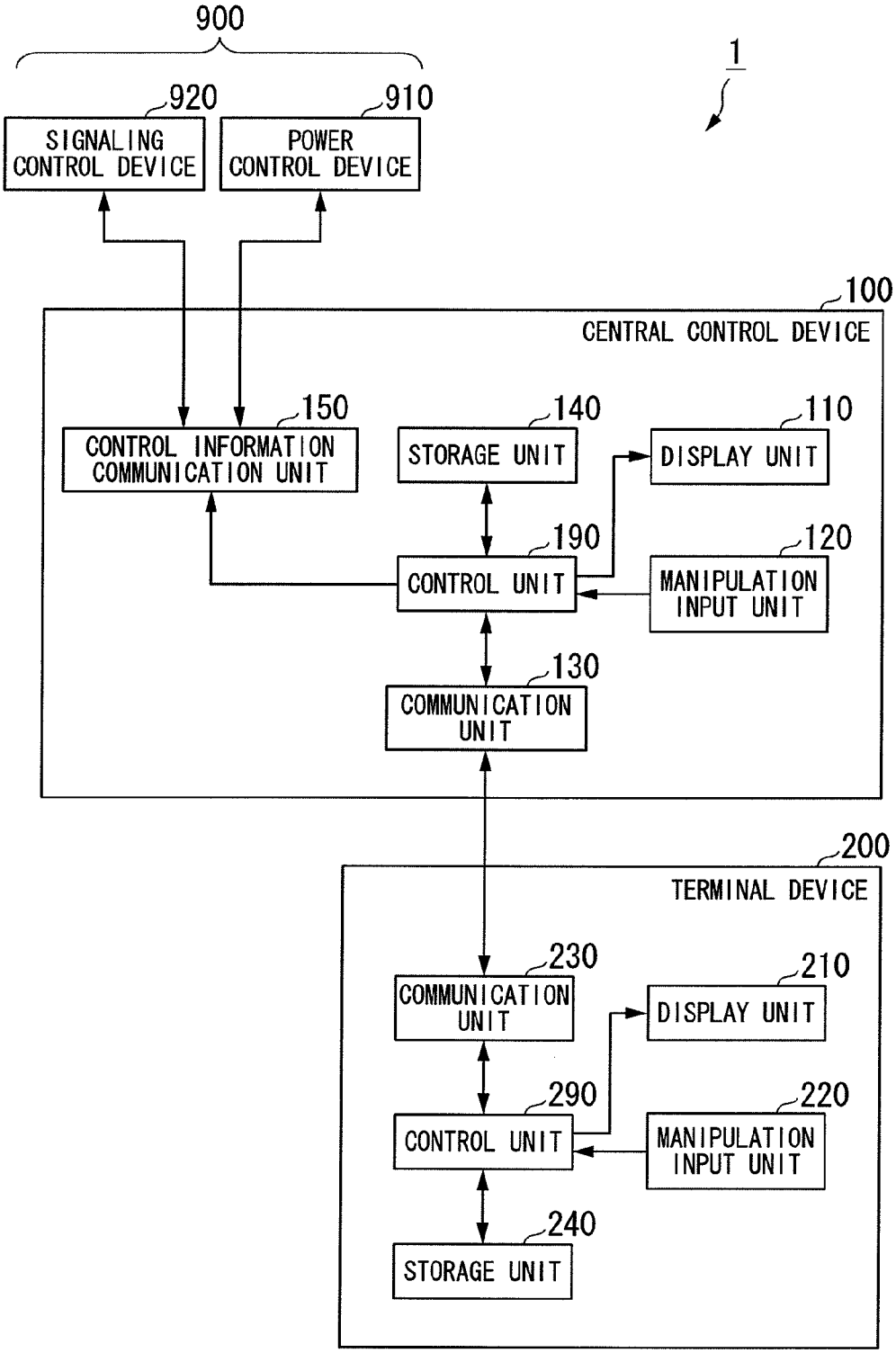
FIG. 1 is a configuration diagram showing a schematic configuration of a rail transportation control system of an embodiment of the present invention.

FIG. 1 is a configuration diagram showing a schematic configuration of a rail transportation control system in an embodiment of the present invention. In FIG. 1, a rail transportation control system (control system) 1 includes a central control device (a control device) 100, a terminal device (a terminal device of a maintenance worker) 200, a power control device 910, and a signaling control device 920. The central control device 100 includes a display unit 110, a manipulation input unit (second input unit) 120, a communication unit (first communication unit) 130, a storage unit 140, a control information communication unit 150, and a control unit 190. The terminal device 200 includes a display unit 210, a manipulation input unit (first input unit) 220, a communication unit (second communication unit) 230, a storage unit 240, and a control unit (request generation unit or lock request generation unit) 290.

The rail transportation control system 1 controls each unit of the rail transportation system, such as a power system or a signaling system. In particular, the rail transportation control system 1 controls the power control device 910 and the signaling control device 920 in maintenance work so that the maintenance work is safely performed.

The power control device 910 and the signaling control device 920 are examples of target devices controlled by the central control device 100, respectively. Hereinafter, the power control device 910 and the signaling control device 920 are collectively referred to as a target device 900.

The power control device 910 supplies electrical power to wires of a maintenance work area, which is an area where the maintenance work is performed. When the worker contacts the wires, the worker receives an electric shock. In this regard, the power control device 910 has an influence on the safety of the maintenance work.

Further, the signaling control device 920 controls the maintenance work area and a signaling device in the vicinity of the maintenance work area. During the maintenance work, when a display for approval of entry into the maintenance work area is performed on the signaling device by the signaling control device 920, an electric train may enter the maintenance work area. In this regard, the signaling control device 920 has an influence on the safety of the maintenance work.

Here, the control unit 190 of the central control device 100 controls the power control device 910 and the signaling control device 920 in the maintenance work to enter a first state in which the maintenance work is safely performed (a maintenance-allowed state). In this case, the control unit 190 controls the power control device 910 not to supply electrical power to the wires of the maintenance work area. Further, the control unit 190 controls the signaling control device 920 so that the signaling control device 920 performs display of prohibition of entry into the maintenance work area on the signaling device.

Also, the target device controlled by the central control device 100 is not limited to a control device, such as the power control device 910 or the signaling control device 920 shown in FIG. 1. The target device may be a device that performs state transition, which can be controlled by the central control device 100. For example, the central control device 100 may directly control the signaling device. In this case, the signaling device is the target device. Alternatively, a switch machine may be the target device.

Further, the target device is not limited to a device that is a maintenance target. The maintenance work area and the device in the vicinity of the maintenance work area or various devices for controlling such a device may be the target devices. For example, when maintenance work for a railroad track (e.g., maintenance work for a rail or a switch machine) is performed, a control device for controlling the switch machine as the maintenance target, a signaling device for displaying whether entry into the maintenance work area in which the maintenance work for the railroad track is performed is allowed, a control device for controlling the signaling device, or the like may be the target device.

The central control device 100 is disposed in an operation control center (OCC), for controlling the rail transportation control system 1 in a centralized manner. In particular, the central control device 100 receives a request relating to control of the target device 900 from the terminal device 200, and performs the above-described control on the target device 900 in response to the request.

The display unit 110 has a display screen such as a liquid crystal display or a plasma display, and displays an image, a character or the like under control of the control unit 190. In particular, the display unit 110 displays a form of a work order, an approval request (information indicating that an instruction has been confirmed), or information on a control situation of the target device 900, which will be described later.

The manipulation input unit 120 includes an input device, such as a keyboard, a mouse, or a push button for executing a safety measure, which will be described later, and receives an input manipulation by an ordering person in the operation control center (hereinafter, referred to simply as an "ordering person"). In particular, the manipulation input unit 120 receives an input manipulation to the form of the work order in a state in which the display unit 110 displays the form of the work order. Further, the manipulation input unit 120 receives an input of the result of confirming the approval request in a state in which the display unit 110 displays the approval request.

The communication unit 130 performs wireless communication with the communication unit 230 of the terminal device 200.

The communication unit 130 performs exchange of various data with the communication unit 230. For example, the communication unit 130 transmits the work order to the communication unit 230 and receives the approval request.

The storage unit 140 stores the form of the work order, various data such as management data for a safety measure indicating a state of control of the target device 900 by the central control device 100, a program for realizing a function of the control unit 190, or the like. Further, the storage unit 140 functions as a working memory of the control unit 190.

The control information communication unit 150 transmits a corresponding control signal to the target device 900 under control of the control unit 190. That is, the control unit 190 controls the target device 900 by transmitting the control signal to the target device 900 via the control information communication unit 150.

The control unit 190 includes a CPU (Central Processing Unit) for reading and executing a program from the storage unit 140 and controls each unit of the central control device 100. Further, the control unit 190 controls the target device 900 as described above and notifies the terminal device 200 of a control situation via the communication unit 130.

The terminal device 200 is, for example, a portable PC (Personal Computer) or PDA (Personal Digital Assistant), and is carried by the worker at a worksite where the maintenance work is performed. The terminal device 200 transmits a request for PIN lock or a request for PIN lock release to the central control device 100 in response to a manipulation of the worker. Further, the terminal device 200 displays a situation of the safety measure by the central control device 100, such as an indication of whether the PIN lock is made effective.

The display unit 210 has a display screen such as a liquid crystal display, and displays an image, a character or the like under control of the control unit 290. In particular, the display unit 210 displays the work order, which will be described later, or information on a situation of the control of the target device 900 by the central control device 100.

The manipulation input unit 220 has, for example, an input device such as a keyboard or a touch panel and receives an input manipulation of the worker. In particular, in a state in which the display unit 210 displays a work order as a form of an approval request for the maintenance work, the manipulation input unit 220 receives an input manipulation to the form of the approval request.

The communication unit 230 performs wireless communication with the communication unit 130 of the central control device 100. The communication unit 230 performs exchange of various data with the communication unit 130. For example, the communication unit 230 receives the work order from the communication unit 130 and transmits the approval request The storage unit 240 stores various data such as data of a route map displayed by the display unit 210 in response to a request from the worker, programs for realizing functions of the control unit 290, or the like. Further, the storage unit 240 functions as a working memory of the control unit 290.

The control unit 290 is realized by the CPU included in the terminal device 200 reading and executing the program from the storage unit 240, and controls each unit of the terminal device 200. In particular, the control unit 290 generates a lock request to request the central control device 100 to maintain the first state (a state in which the safety measure is performed) or a release request (lock release request) to request the central control device 100 to release the first state in response to an input manipulation by the worker using the manipulation input unit 220, and transmits the request to the central control device 100 via the communication unit 230.

Next, screens displayed by the terminal device 200 or the central control device 100 will be described with reference to FIGS. 2 to 4.

Figure 2:
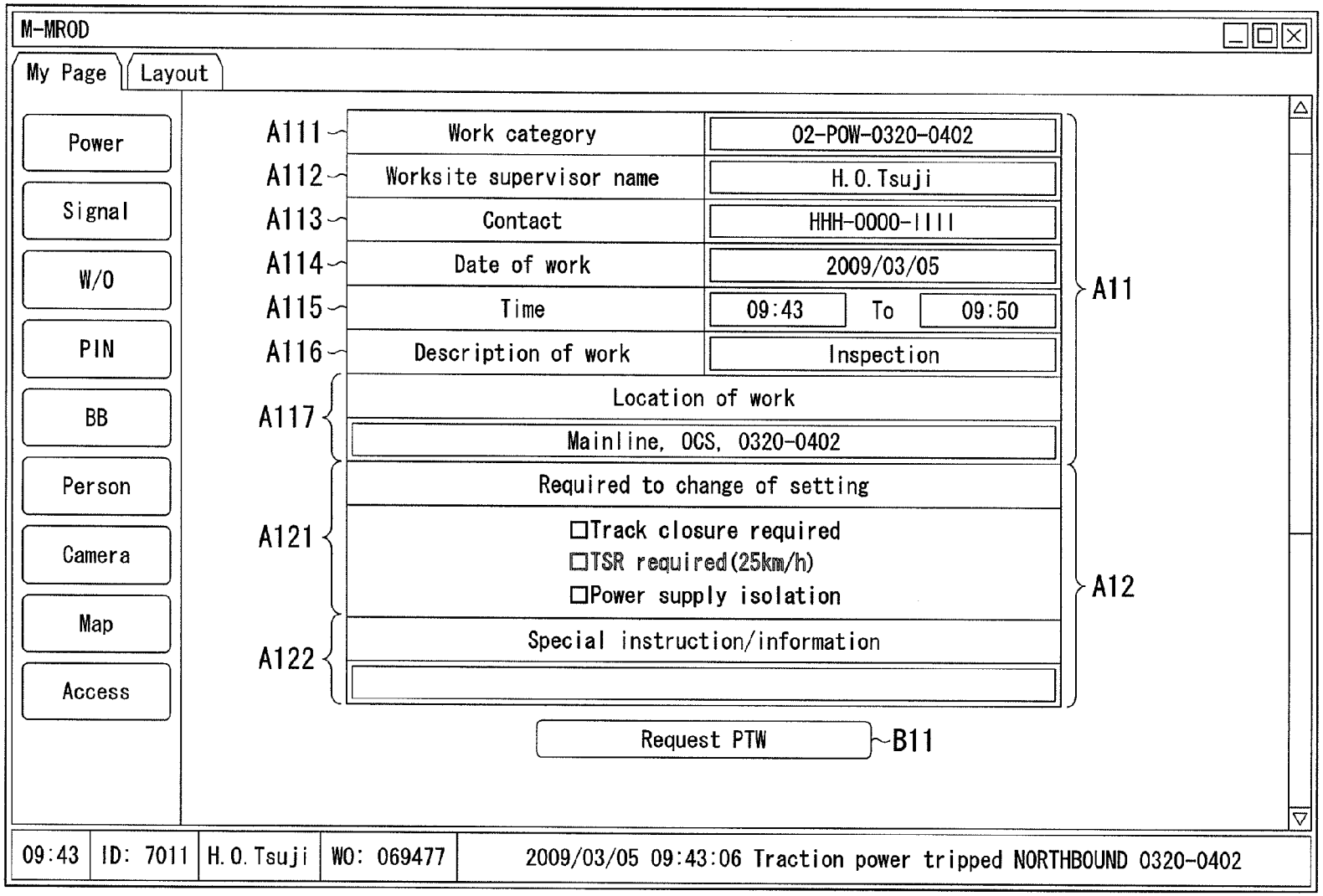
FIG. 2 is a diagram showing an example of a work order displayed by a display unit of a terminal device of the embodiment.

FIG. 2 is a diagram showing an example of the work order displayed by the display unit 210 of the terminal device 200. When the communication unit 230 receives the work order transmitted from the central control device 100, the display unit 210 displays the work order under control of the control unit 290.

In FIG. 2, the work order includes areas A11 and A12.

The area A11 is a display area for content of the maintenance work, and includes a display area A111 for an identification code indicating a work category, a display area A112 for a work supervisor name, a display area A113 for a contact telephone number, a display area A114 for a date of the maintenance work, a display area A115 for a time of the maintenance work, a display area A116 for a description of the work, and a display area A117 for the location of the maintenance work.

Further, the area A12 is a display area for a safety measure for the maintenance work, and includes a selection area A121 for items of the safety measure requested by the worker (Required to change of setting), and a display area A122 for special instruction/information. Further, in the area A121, a safety measure option requested by the worker, an option (Track closure required) for making a request to prohibit entry of a train, and an option (TSR required (25 km/h)) for requesting a speed restriction to restrict a train speed to be equal to or less than 25 km per hour, and an option (Power supply isolation) for requesting stop of power supply are displayed. Among these, the option for making a request to prohibit entry of a train and the option for requesting stop of power supply are selectable in the example shown in FIG. 2.

The work order is also used as a form of an approval request to request approval of the maintenance work and execution of the safety measure.

For example, in a state in which the display unit 210 displays the work order of FIG. 2, the worker confirms that there is no mistake or deficiency in each item shown in the area A11 and then selects a necessary safety measure from the items displayed in the area A121.

The selection of the safety measure is performed, for example, by the worker touching the items of the necessary safety measure on the display screen of the display unit 210. When the item of the safety measure is touched, a location touched on the display screen is detected by a touch panel included in the manipulation input unit 220. The manipulation input unit 220 outputs the detected location to the control unit 290. The control unit 290 judges the selected item based on the location output from the manipulation input unit 220, and inverts a display of a check box of the selected item. That is, when a check mark is not displayed, which indicates that the check box of the selected item has not been selected, a check mark is displayed in the check box. On the other hand, when the check mark is displayed, which indicates that the check box of the selected item has been checked, the check mark of the check box is removed.

After the worker performs the selection of the safety measure, the worker performs a manipulation to request approval. Then, the control unit 290 outputs the work order in which the safety measure has been selected, as an approval request, to the communication unit 230. The manipulation to request approval is performed, for example, by the worker touching a button B11 having an indication for requesting a request for approval (Request PTW) on the display screen of the display unit 210.

The communication unit 230 transmits the request for approval output from the control unit 290 to the central control device 100.

As will be described below, in the central control device 100, the ordering person confirms the request for approval transmitted from the terminal device 200. When the request for approval is accepted by the ordering person, the central control device 100 controls the target device 900 to enter the first state.

Figure 3:
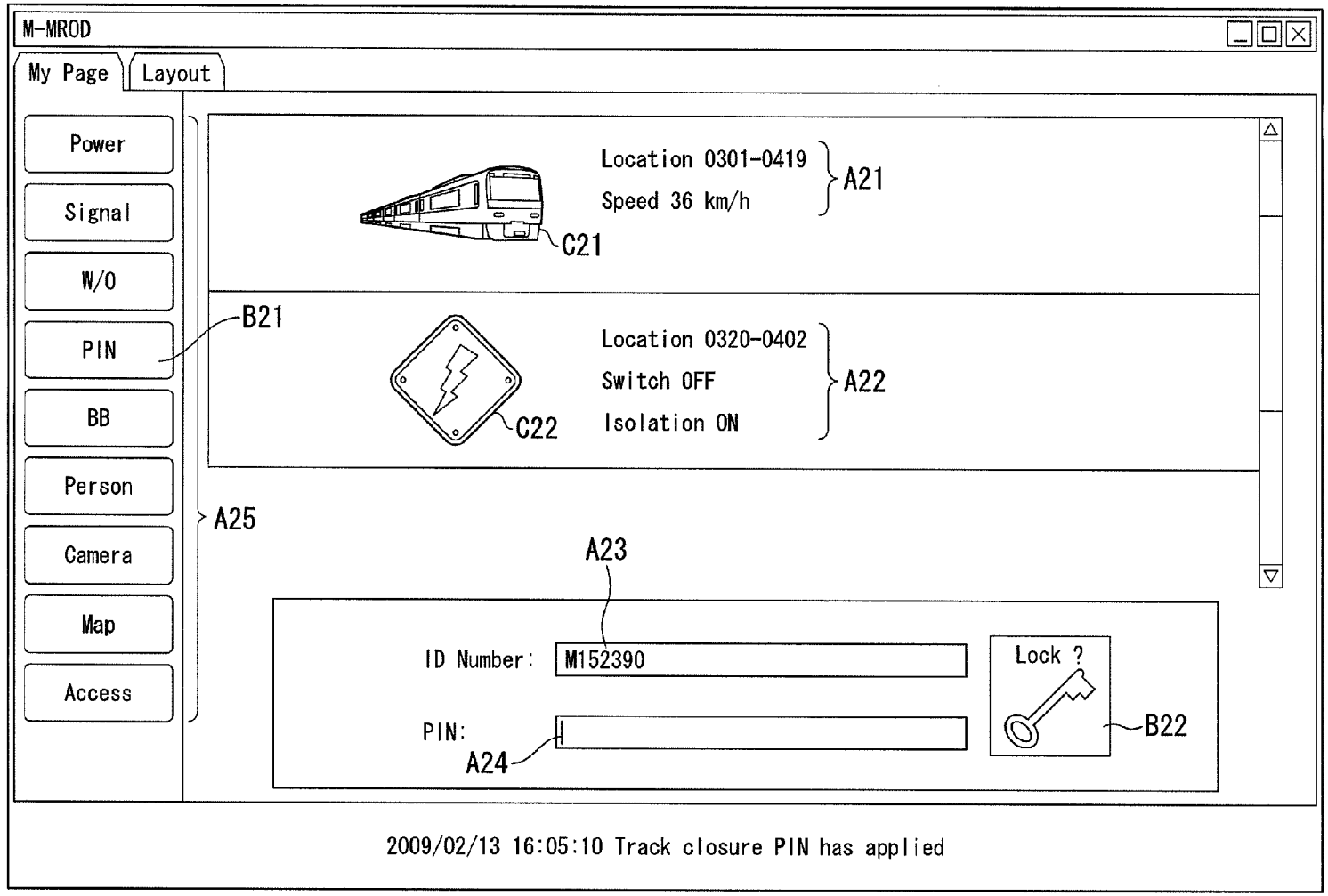
FIG. 3 is a diagram showing an example of a PIN input screen displayed by the display unit of the terminal device of the embodiment.
Figure 4:
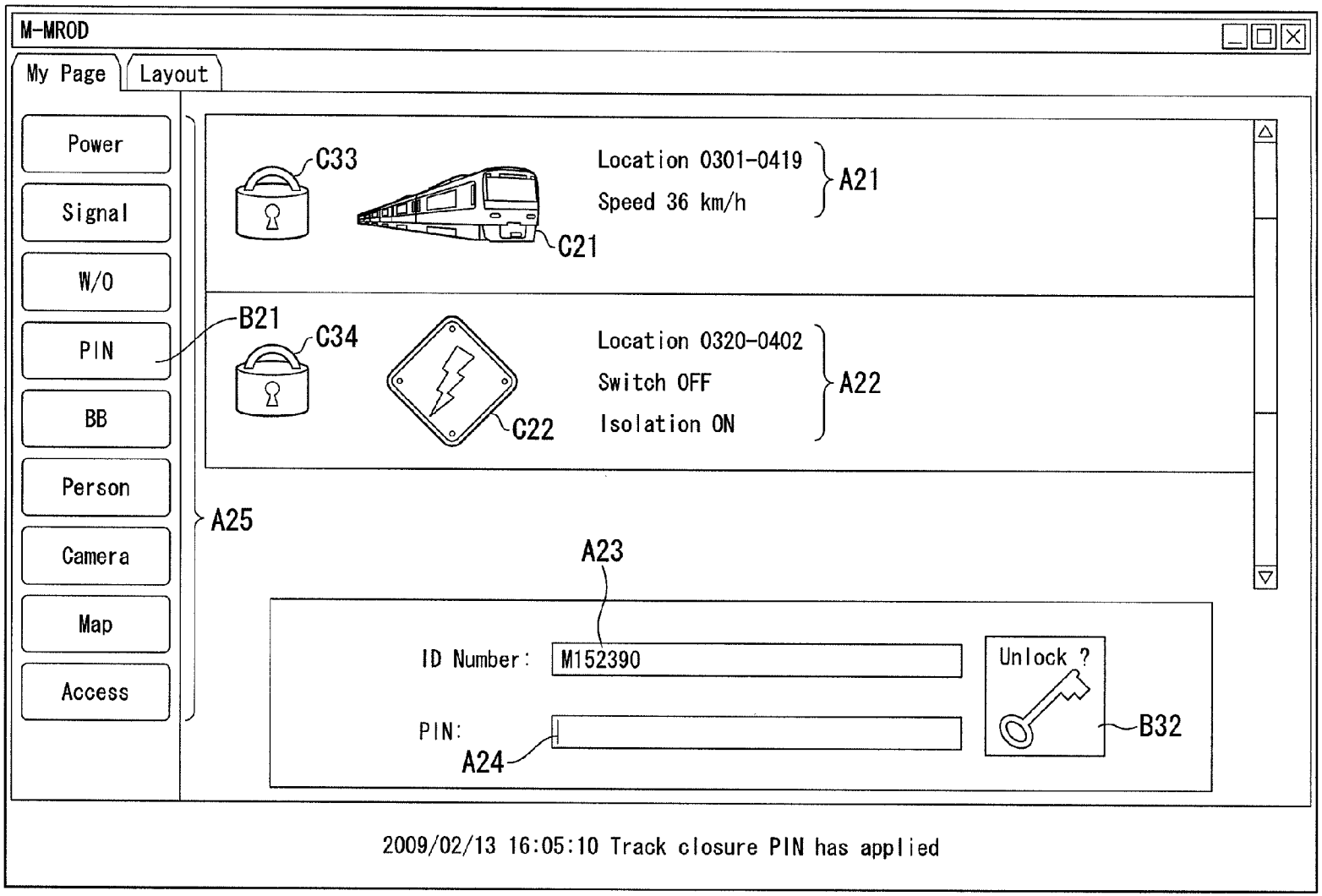
FIG. 4 is a diagram showing an example of a PIN input screen displayed by the display unit of the terminal device of the embodiment.

FIGS. 3 and 4 are diagrams showing examples of a PIN input screen displayed by the display unit 210 of the terminal device 200. This PIN input screen is always displayed, for example, on the display unit 210. In an area A25 for selecting the screen displayed on the display unit 210, the PIN input screen is displayed by the worker pushing the button B21 for selecting the PIN input screen (touching the button B21 on the screen).

FIG. 3 shows an example of the PIN input screen displayed in a state in which PIN lock is not performed.

Here, the PIN lock refers to a state in which the central control device 100 controls the target device 900 to maintain a first state in which the maintenance work can be safely performed and, in principle, the first state is not changed when the worker does not request to release the PIN lock. Also, the PIN lock is an example of a lock state in the present embodiment. The confirmation of a right upon transitioning to the lock state is not limited to use of the PIN (Personal Identification Number) of the worker and may be performed using, for example, biological information of the worker. Similarly, release of the PIN lock, which will be described, is an example of release of the lock state in the present embodiment.

The PIN input screen shown in FIG. 3 when the PIN lock is not performed is a screen on which a PIN is input when the worker requests the PIN lock.

In the PIN input screen shown in FIG. 3, each of areas A21 and A22 indicates a safety measure that is being performed by the central control device 100. The area A21 indicates speed restriction in a 0301-0419 km section that is a designated section. Such a designated section is specified, for example, by a distance (kilometers) from a reference point of a start point and an end point of the designated section, which is used, for example, in a road or a railroad. The speed restriction indicates, for example, temporary speed restriction due to accidents. Further, the area A22 indicates that power supply is OFF (stop of power supply) in a designated section, i.e., a 0320-0402 km section. As described in FIG. 2, the safety measure is performed by the central control device 100 when the worker selects items from among the items of the safety measure indicated on the work order and the ordering person approves the selection (accepts the approval request).

Further, an icon C21 is displayed in the area A21 of the PIN input screen of FIG. 3, and an icon C22 is displayed in the area A22. The icons C21 and C22 indicate the safety measures that are being performed, respectively. The reference number corresponding to the work order is displayed in an area A23. As will be described below, the reference number corresponding to the work order is an identification number (ID Number) of the work order. The reference number corresponding to the work order is also used as an identification number of the maintenance work.

A manipulation for a request for PIN lock is performed by inputting the PIN. For example, the worker selects a PIN input area A24 (touches the screen) and then inputs the PIN from the keyboard. The input PIN is displayed in the area A24 by the control unit 290 and the display unit 210. After completing the PIN input, the worker requests the PIN lock by pushing a lock request button B22 for requesting the PIN lock (e.g., touches the display screen). Based on this request for PIN lock, the central control device 100 transitions to a PIN lock state, as will be described below.

FIG. 4 shows an example of the PIN input screen displayed in the state in which the PIN lock has been performed. This PIN input screen is a screen for inputting the PIN when the worker requests release of the PIN lock.

In the PIN input screen shown in FIG. 4, the same reference numerals A21, A22, A23, A24, B21, C21, and C22 are assigned to parts displaying the same content as the respective unit of FIG. 3, and a description of the parts will be omitted.

Icons C33 and C34 indicate that the safety measure is PIN-locked.

The icon C33 indicates that the safety measure displayed in the area A21 is PIN-locked. Thus, in a state of FIG. 4 in which the icon C34 has been displayed, in principle, the speed restriction indicated in the area A21 continues to be performed, as long as the request for PIN lock release is not made by the worker.

Further, the icon C34 indicates that the safety measure indicated in the area A22 is PIN-locked. Thus, in a state of FIG. 4 in which the icon C33 has been displayed, in principle, the state indicated in the area A22 in which power supply is OFF is maintained, as long as the request for PIN lock release is not made by the worker.

Further, in FIG. 4, an unlock request button B32 for requesting the release of the PIN lock is displayed instead of the lock request button B22 of FIG. 3.

Similar to the manipulation for a request for PIN lock, a manipulation for a request for PIN lock release is performed by inputting the PIN. In the example of FIG. 4, the worker requests the release of the PIN lock by inputting the PIN to the PIN input area A24 and pressing the unlock request button B32 (e.g., touching the display screen). Based on this request for PIN lock release, the central control device 100 releases the lock state as will be described below.

Figure 5:
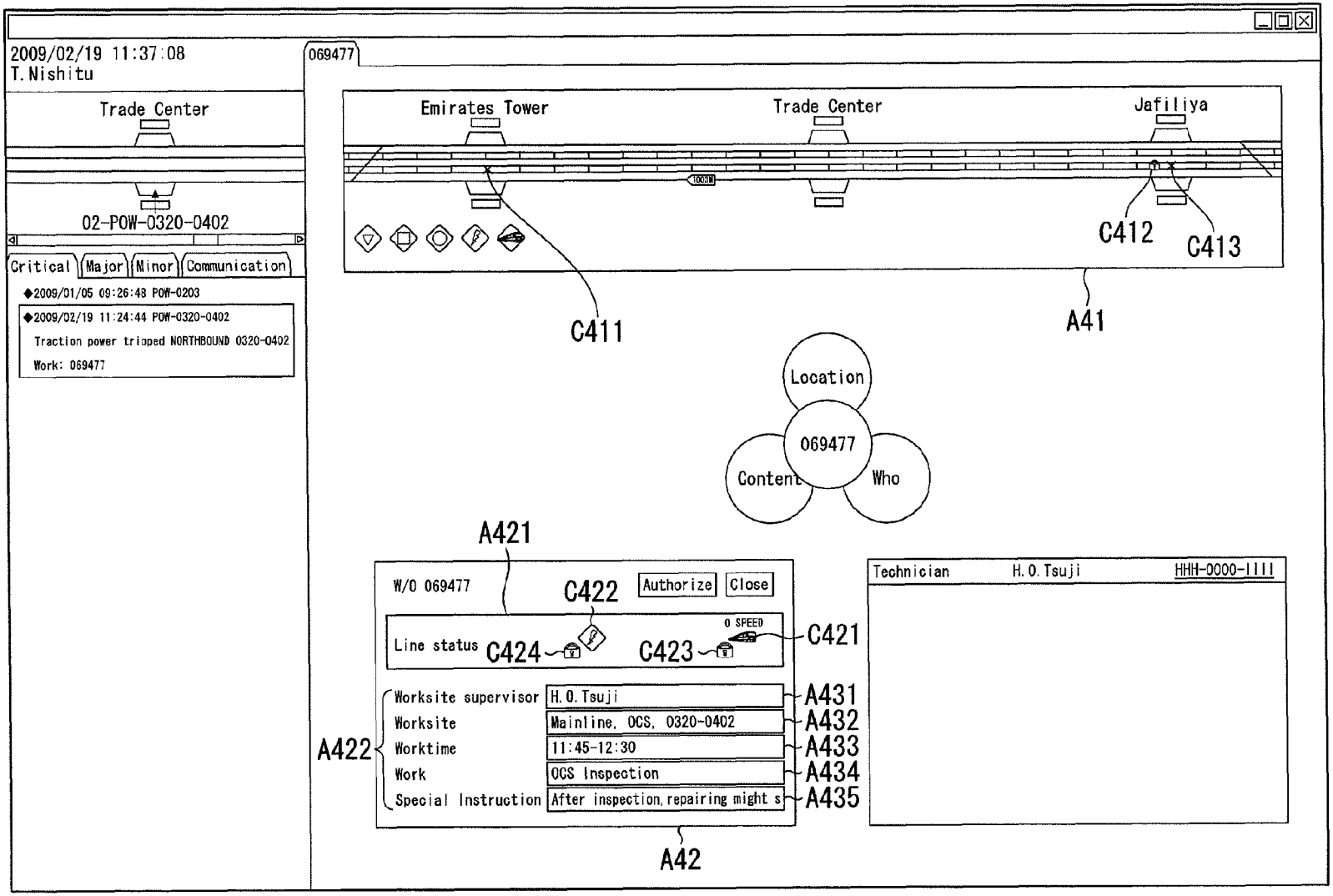
FIG. 5 is a diagram showing an example of a screen displayed by a display unit of a central control device in a state in which the PIN lock is performed in the embodiment.

FIG. 5 is a diagram showing an example of the display screen of the display unit 110 of the central control device 100 in a state in which the PIN lock has been performed.

In FIG. 5, a power supply situation in a maintenance work area and the vicinity of the maintenance work area is displayed in an area A41. A state in which power supply is OFF (power supply stops) in a section between × icons C411 and C413 is shown by displaying the × icons C411 and C413 and suppressing display brightness of a route between the × icons. The state in which the power supply is OFF is performed by the central control device 100 controlling the power control device 910.

Further, an icon C412 indicates that the state in which power supply is OFF in the section between the × icons C411 and C413 is PIN-locked.

Further, a diagram showing content of the maintenance work or an execution situation of the safety measure is displayed in an area A42.

An area A421 is a display area for the execution situation of the safety measure, and the execution situation of the safety measure is displayed by icons C421 to C424. The icon C421 indicates speed restriction performed as the safety measure, similar to the icon C21 (refer to FIG. 3). The icon C422 indicates the state in which the power supply is OFF, which is shown in the area A41. The icon C423 indicates that the safety measure (speed restriction) indicated by the icon C421 is PIN-locked, similar to the icon C33 (refer to FIG. 4). The icon C424 indicates that the safety measure indicated by the icon C422 (the state in which the power supply is OFF) is PIN-locked, similar to the icon C34.

An area A422 is an area in which content of the maintenance work is displayed, and includes a display area A431 for a name of a work supervisor, a display area A432 a maintenance work location (Worksite), a display area A433 for a maintenance work time (Worktime), a display area A434 for an explanation of work (Work), and a display area A435 for special instruction/information.

The terminal device 200 also displays the safety measure performed by the central control device 100 or presence or absence of the PIN lock.

Here, the terminal device 200 is a portable terminal device. The display screen of the terminal device 200 is smaller than that of the central control device 100. Here, for example, the terminal device 200 displays the view selected from among the view of the area A41 and the view of the area A42 in response to a screen selection manipulation by the worker received by the manipulation input unit 220.

Next, management data for safety measures stored in the storage unit 140 will be described with reference to FIG. 6.

FIG. 6 is an illustrative diagram showing a data structure of the management data for safety measures stored in the storage unit 140.

One row of the management data for safety measures shown in FIG. 6 corresponds to one maintenance work. Each row includes a first column for storing the reference number corresponding to the work order, a second column for storing the PIN, and a third column and subsequent columns for storing state information for respective safety measures.

The reference number corresponding to the work order stored in the first column is an identification number corresponding to the work order, for example, a serial number assigned to each work order. The work order is produced for each maintenance work, and the reference number corresponding to the work order is also used as an identification number of the maintenance work. As described below, when producing the work order, the control unit 190 adds a work instruction number to the work order. In this case, the control unit 190 stores the reference number corresponding to the work order in the storage unit 140 (writes the reference number corresponding to the work order to the first column of the management data for safety measure).

The PIN stored in the second column is an identification number for identifying the worker, as described above. Persons having a right to request the PIN lock described in FIG. 3 (authorized person) are limited to some persons for each maintenance work, such as the work supervisor, and PINs of all the authorized persons are stored in the PIN storage column. Specifically, when producing the work order, the ordering person determines a authorized person and inputs the PINs of all the authorized persons using the manipulation input unit 120. The control unit 190 writes all the PINs received by the manipulation input unit 120 to the second column for storing the PIN, of the row for maintenance work as a target. As will be described below, this PIN indicates a destination of the work order. Further, the PIN stored in the second column is used when the control unit 190 judges whether there is a request for PIN lock from the authorized person upon receipt of the request for PIN lock.

The third column and subsequent columns for storing state information are provided for respective safety measures and store the execution situations of the safety measures.

Here, a zone to which the power control device 910 supplies electrical power is divided into some sections in advance. The ordering person determines whether the electrical power is to be supplied to each divided section. That is, the ordering person executes the safety measure in units of sections. Similarly, a zone in which the signaling control device 920 controls the signaling device is divided into some sections in advance. The ordering person determines content to be displayed on the signaling device for each divided section. That is, the ordering person executes the safety measure in units of section. Here, each row of the management data for safety measure has columns for storing state information for each divided section, that is, for each execution unit of the safety measure with respect to each of the power control device 910 and the signaling control device 920.

Data indicating any of "NA," "Not yet," "Execute" and "Lock" is stored in each column for storing the state information according to the execution situation of the safety measure. Here, "NA" indicates that a corresponding safety measure is not performed in corresponding maintenance work, that is, the maintenance work is not a target of the safety measure. "Not yet" indicates a state in which the corresponding safety measure has not yet been performed. "Execute" indicates that the corresponding safety measure is being executed. "Lock" indicates that the corresponding safety measure has been PIN-locked.

Next, an overview of an operation of the rail transportation control system 1 will be described with reference to FIGS. 7 to 12. FIGS. 7 to 12 are sequence diagrams showing an example of operation of the rail transportation control system 1.

Figure 7:
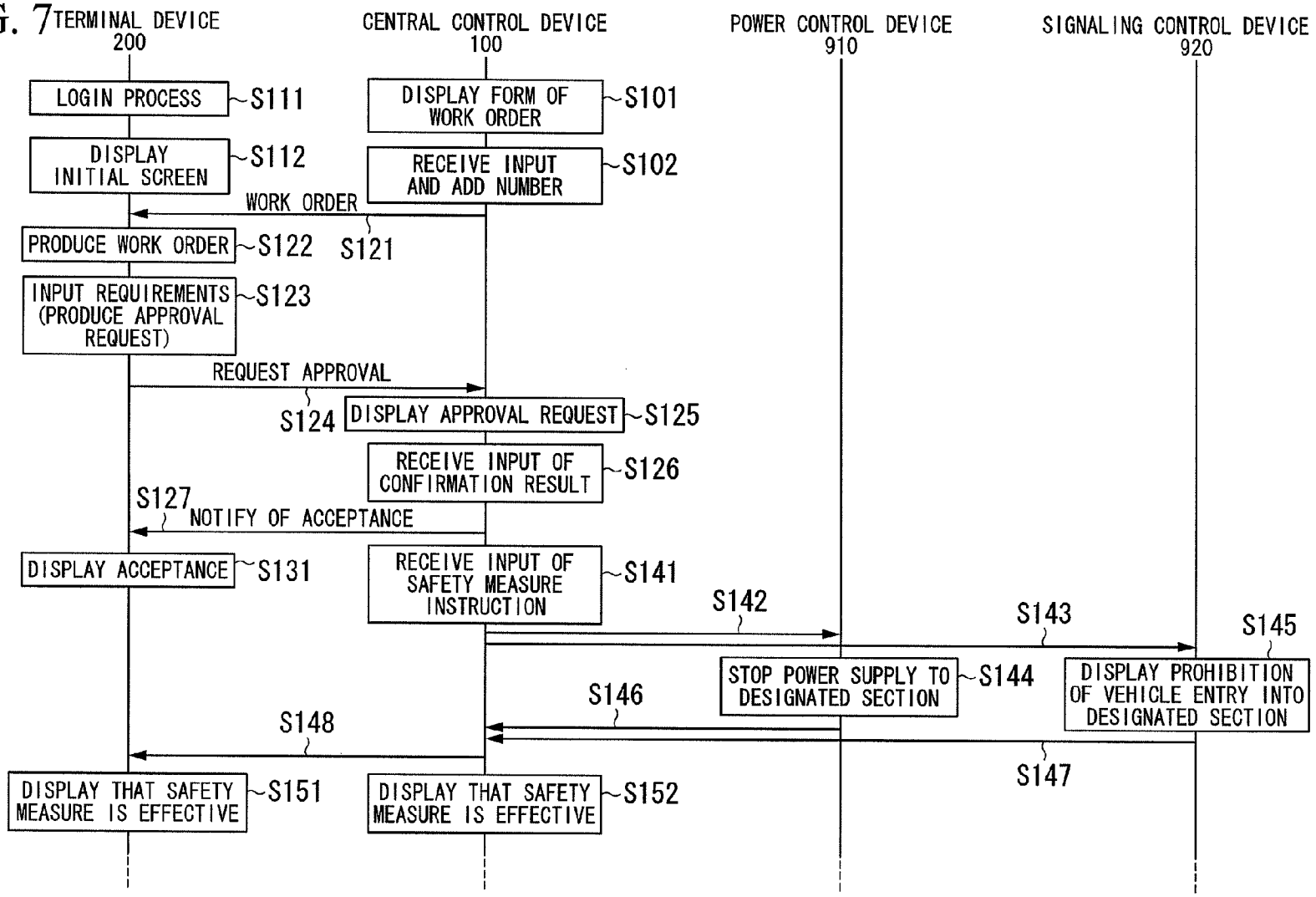
FIG. 7 is a sequence diagram showing an example of operation of the rail transportation control system.

FIG. 7 is a sequence diagram showing an example of operation of the rail transportation control system 1 in a process from the production of the work order in the central control device 100 to the display of the safety measure by the central control device 100 and terminal device 200 being effective. The rail transportation control system 1 initiates the process of FIG. 7, for example, when power equipment on the route fails.

First, in the central control device 100, sequence S101 is executed. Specifically, the manipulation input unit 120 receives a request to display a production form for the work order from the ordering person. Then, the control unit 190 reads the production form for the work order stored in the storage unit 140 and displays the production form on the display unit 110.

Next, sequence S102 is executed. Specifically, the manipulation input unit 120 receives a manipulation for inputting requirements by the ordering person for the production form for the work order displayed by the display unit 110. The control unit 190 produces the work order based on the input manipulation received by the manipulation input unit 120, adds the reference number corresponding to the work order to the work order, and outputs the work order to the communication unit 130.

The sequence S121 is executed. Specifically, the communication unit 130 transmits the work order output from the control unit 190, together with the reference number corresponding to the work order, to the communication unit 230 of the terminal device 200.

On the other hand, in the terminal device 200 carried by the worker at a maintenance worksite, sequence S111 is executed. Specifically, the manipulation input unit 220 receives a manipulation for inputting a user ID and a password by the worker and outputs the manipulation to the control unit 290. The control unit 290 performs a login process such as user authentication based on the user ID and the password. When the login is successful, sequence S112 is executed. Specifically, the control unit 290 displays an initial screen on the display unit 110. The display unit 110 displays, as the initial screen, for example, any one of a route map of a rail (an overall map or a detailed map of the vicinity of the maintenance work area), a view indicating information of a vehicle location on the route map, a view indicating an ON/OFF situation of power equipment, information of a current location of the terminal device (GPS (Global Positioning System) information), a worker schedule table, and a worker profile, or a combination thereof.

In the above-described sequence S121, when the communication unit 230 receives the work order transmitted from the central control device 100, sequence S122 is executed. Specifically, the control unit 290 displays the work order on the display unit 210.

As described in FIG. 2, the work order is also used as the form of the approval request to request approval of the maintenance work and the execution of the safety measure. Sequence S123 is executed. Specifically, in a state in which the display unit 210 displays the work order as the form of the approval request, the manipulation input unit 220 receives an input manipulation for requirements of the approval request. Then, the control unit 290 produces the approval request based on the input received by the manipulation input unit 220. Here, the input manipulation for requirements of the approval request is, for example, a manipulation for selecting the safety measure required for the maintenance work (a manipulation for touching the item shown in the area A121 of FIG. 2) described in FIG. 2. Also, a matter to be input in the approval request is not limited to the selection of the safety measure described in FIG. 2. For example, a check box may be provided for each item in the area A11 of FIG. 2, and the worker may confirm each item and check the check box. Further, a checklist for maintenance work preparation, such as whether a helmet is worn, may be included in the work order and checked by the worker.

Sequence S124 is executed. Specifically, the control unit 290 outputs the approval request produced in sequence S123 to the communication unit 230, and the communication unit 230 transmits the approval request to the central control device 100.

In the central control device 100, when the communication unit 130 receives the approval request from the terminal device 200, sequence S125 is executed. Specifically, the control unit 190 displays the approval request on the display unit 110. Sequence S126 is executed. Specifically, the ordering person confirms the approval request displayed by the display unit 110, judges whether there is no problem in content of the maintenance work or equipment, and performs a manipulation for inputting the confirmation result (the result of judging whether there is no problem) in the manipulation input unit 120. In the example of FIG. 7, the manipulation input unit 120 receives an input manipulation of the confirmation result indicating that there is no problem.

Sequence S127 is executed. Specifically, the control unit 190 produces an acceptance notification for the approval request that is a notification indicating that there is no problem in the approval request, based on the input manipulation received by the manipulation input unit 120, and outputs the acceptance notification to the communication unit 130. The communication unit 130 transmits this acceptance notification to the terminal device 200.

In the terminal device 200, sequence S131 is executed. Specifically, the communication unit 230 receives the acceptance notification from the central control device 100, and the control unit 290 displays the acceptance notification on the display unit 210.

Further, in the central control device 100, sequence S141 is executed. Specifically, after the acceptance notification is transmitted in sequence S127, the manipulation input unit 120 receives an input manipulation to instruct execution of the safety measure, and outputs information indicating the received input manipulation to the control unit 190. For example, the manipulation input unit 120 has, in each given section, a push button for instructing to stop power supply, and receives pressing of the push button. The manipulation input unit 120 outputs information, for instructing to stop supply of electrical power to the section corresponding to the pressed push button, to the control unit 190. Further, the manipulation input unit 120 has, in each given section, a push button for instructing vehicle entry prohibition and receives pressing of the push button. The manipulation input unit 120 outputs information for instructing vehicle entry prohibition into the section corresponding to the pressed push button, to the control unit 190.

In the example of FIG. 7, the ordering person presses the push button for instructing to stop power supply to a maintenance work area, and the push button for instructing prohibition of vehicle entry into the maintenance work area. The manipulation input unit 120 outputs instructions to stop power supply to the maintenance work area and instruction, prohibiting vehicle entry into the maintenance work area, to the control unit 190.

The control unit 190 controls the target device 900 to enter the first state in which the maintenance work is safely performed, according to the information output from the manipulation input unit 120 (i.e., executes the safety measure).

In this case, the control unit 190 first executes sequence S142. Specifically, based on the information for instructing to stop power supply to a maintenance work area output from the manipulation input unit 120, the power control device 910 transmits control information, for instructing to stop the power supply to the maintenance work area, to the power control device 910 via the control information communication unit 150. Sequence S144 is executed according to this control information. Specifically, the power control device 910 stops power supply to the designated section (the maintenance work area). Further, the control unit 190 executes sequence S143. Specifically, based on the information for instructing prohibition of vehicle entry into the maintenance work area output from the manipulation input unit 120, the signaling control device 920 transmits control information for instructing signal display indicating prohibition of vehicle entry into the maintenance work area, to the signaling control device 920 via the control information communication unit 150. According to this control information, the signaling control device 920 executes the sequence S145. Specifically, the signaling control device 920 controls the signaling device, which is a control target, to display prohibition of vehicle entry into the designated section (the maintenance work area).

The power control device 910 having completed the process of stopping power supply to the designated section in sequence S144 executes sequence S146. Specifically, the power control device 910 outputs information indicating that the power supply has stopped, to the central control device 100. Similarly, the signaling control device 920 having completed the process of making the signal display indicating vehicle entry prohibition to the designated section in sequence S145 executes the sequence S147. Specifically, the signaling control device 920 outputs information indicating vehicle entry prohibition to the central control device 100.

In the central control device 100, sequence S148 is executed. Specifically, the control unit 190 acquires the information transmitted from the target device 900 via the control information communication unit 150. The control unit 190 transmits information, indicating that the safety measure is made effective, to the terminal device 200 via the communication unit 130.

In the terminal device 200, sequence S151 is executed. Specifically, the communication unit 230 receives the information from the control unit 190 and outputs the information to the control unit 290, and the control unit 290 displays that the safety measure is being executed, on the display unit 210.

Further, the control unit 190 executes sequence S152. Specifically, based on the acquired information, the control unit 190 displays that the safety measure is being executed, on the display unit 110. The display indicating that the safety measure is being executed is performed, for example, by changing the brightness of the route and displaying a × icon like the icon C411 on the screen described in FIG. 5.

Figure 8:
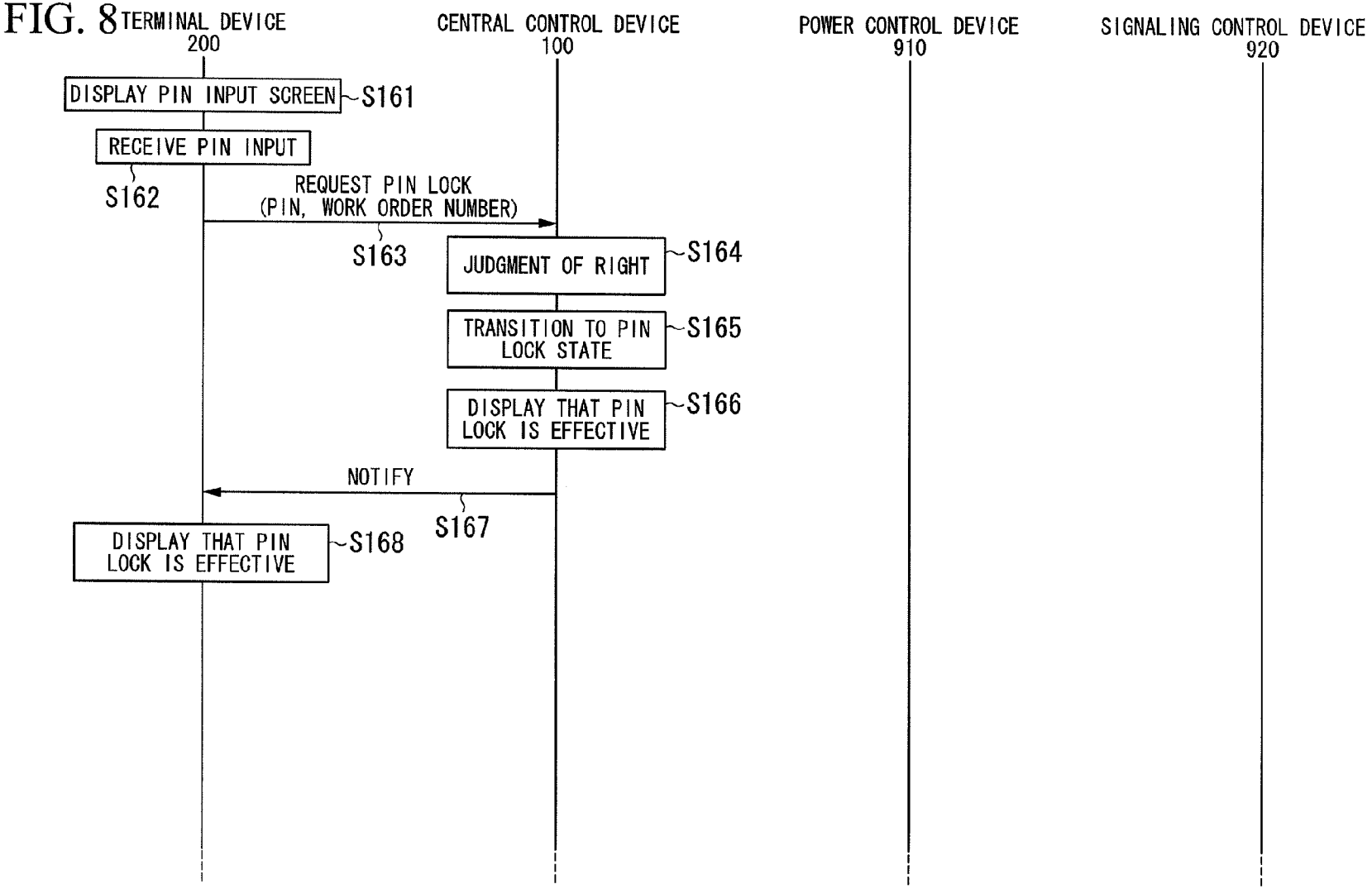
FIG. 8 is a sequence diagram showing an example of operation of the rail transportation control system.

FIG. 8 is a sequence diagram showing an example of operation of the rail transportation control system 1 when the central control device 100 performs PIN lock in response to a request for PIN lock from the terminal device 200 after the safety measure is made effective by the series of processes of FIG. 7.

In the terminal device 200, when the manipulation input unit 220 receives a request to display the PIN input screen, sequence S161 is executed. Specifically, the display unit 210 displays the PIN input screen under control of the control unit 290. As described above in FIGS. 3 and 4, the PIN input screen is a screen for requesting PIN lock or the release of the PIN lock.

A sequence S162 is then executed. Specifically, the manipulation input unit 220 receives a PIN input and a manipulation for requesting the PIN lock, and outputs the PIN and the request for PIN lock to the control unit 290.

For example, the manipulation input unit 220 receives the PIN input from its keyboard and outputs the PIN to the control unit 290. The control unit 290 controls the display unit 210 to display the PIN in the PIN input area (the area A24 in FIG. 3). The manipulation input unit 220 receives pressing of the lock request button (the button B22 in FIG. 3) and outputs a request for PIN lock to the control unit 290.

Next, sequence S163 is executed. Specifically, when the control unit 290 receives the request for PIN lock from the manipulation input unit 220, the control unit 290 generates the request for PIN lock including the reference number corresponding to the work order included in the work order received in sequence S121 (refer to FIG. 7) and the PIN input in sequence S162 and outputs the request for PIN lock to the communication unit 230. The communication unit 230 transmits the request for PIN lock including the reference number corresponding to the work order and the PIN to the central control device 100.

In the central control device 100, sequence S164 is executed. Specifically, the communication unit 130 receives the request for PIN lock including the reference number corresponding to the work order and the PIN and outputs the request for PIN lock to the control unit 190. The control unit 190 judges whether the request for PIN lock is from the person having a right to request PIN lock based on the reference number corresponding to the work order and the PIN included in the request for PIN lock.

Specifically, as described in FIG. 6, authorized persons having a right to request PIN lock are limited to some persons for each maintenance work. The storage unit 140 stores the reference number corresponding to the work order and PINs of all the authorized persons to correspond to each other in advance. The control unit 190 having acquired the request for PIN lock from the communication unit 130 reads the reference number corresponding to the work order from the acquired request for PIN lock, and reads the PIN corresponding to the read reference number corresponding to the work order from the management data for safety measure stored in the storage unit 140. Further, the control unit 190 reads the PIN from the request for PIN lock, and compares the PIN read from the request for PIN lock to the PIN read from the storage unit 140. If the PIN read from the request for PIN lock is coincident with the PIN read from the storage unit 140, the control unit 190 judges that the request for PIN lock is from the person having a right to request PIN lock. On the other hand, if the PIN read from the request for PIN lock is not coincident with the PIN read from the storage unit 140, the control unit 190 judges that the request for PIN lock is from a person having no right to request PIN lock.

Here, a closed PIN enables each worker to input only his or her own PIN. Accordingly, the PIN may be used as a password to request PIN lock or the release of the PIN lock.

Next, sequence S165 is executed. Specifically, when the control unit 190 judges that the request for PIN lock is from the person having a right to request PIN lock, the control unit 190 transitions to a PIN lock state. The transition to the PIN lock state is performed by the control unit 190 rewriting a value of the column for storing the state information, of the management data for safety measure stored in the storage unit 140, to be "lock."

In the present embodiment, the control unit 190 causes all safety measures required for the corresponding maintenance work to be in a PIN lock state based on one request for PIN lock. However, unlike this embodiment, the terminal device 200 may transmit a request for PIN lock for each safety measure and the control unit 190 may perform the PIN lock for each safety measure. Similarly, for the release of the PIN lock, the terminal device 200 may transmit the request for PIN lock release for each safety measure and the control unit 190 may perform the release of the PIN lock for each safety measure. Accordingly, it is possible to minimize influence on the transportation system, for example, by executing only a necessary safety measure at a necessary timing while managing a plurality of works, such as maintenance check for a power system, in a plurality of areas, as one collective maintenance work.

Next, sequence S166 is executed. Specifically, after performing the transition to the PIN lock state, the control unit 190 controls the display unit 110 to display that the PIN lock is made effective. The display that the PIN lock is made effective is performed, for example, by the display unit 110 displaying icons indicating the PIN lock state (icons C412, C423 and C424) on the display screen, as described above in FIG. 5.

Further, sequence S167 is executed. Specifically, the control unit 190 outputs information indicating that the PIN lock is made effective to the communication unit 130, and the communication unit 130 transmits the information to the terminal device 200.

Next, sequence S168 is executed. Specifically, in the terminal device 200, the communication unit 230 receives the information indicating that the PIN lock is made effective and outputs the information to the control unit 290. The control unit 290 controls the display unit 210 to display that the PIN lock is made effective. The display that the PIN lock is made effective is performed, for example, by the display unit 210 displaying the icons indicating the PIN lock state (icons C412, C423, and C424) when displaying the view of each area in FIG. 5, as described in FIG. 5.

After confirming that the PIN lock is made effective on the terminal device 200, the worker executes the maintenance work.

Thus, the central control device 100 transitions to the PIN lock state, which is a state in which the first state is maintained, in response to the request from the terminal device 200. When the central control device 100 transitions to the PIN lock state, the terminal device 200 displays that the PIN lock is made effective.

Accordingly, the central control device 100, in principle, cannot release the safety measure when there is no request from the terminal device 200, that is, from the worker. The central control device 100 displays this state on the terminal device 200. Therefore, it is possible to prevent the safety measure from being released due to erroneous situation recognition or manipulation mistake of the ordering person in the operation control center and to prevent the worker from being in danger. That is, it is possible to reduce the possibility of the worker being in danger.

Further, since the worker can confirm that the safety measure is maintained, it is possible to reduce the anxiety of the worker. Further, since the worker can initiate the maintenance work after confirming that the safety measure is maintained, it is possible to prevent the safety measure from not being performed due to erroneous situation recognition or manipulation mistake of the ordering person and to prevent the worker from being in danger.

Although the PIN lock and the release of the PIN lock are, in principle, performed in response to the request from the terminal device 200, the PIN lock or the release of the PIN lock may be exceptionally performed by manipulating the central control device 100, to cope with a case in which communication is not possible due to failure or battery shortage of the terminal device 200 or poor radio conditions, or when a authorized person making a request for PIN lock is absent or a request to release the PIN lock (e.g., when a authorized person requesting the PIN lock is not included in the workers).

Figure 9:
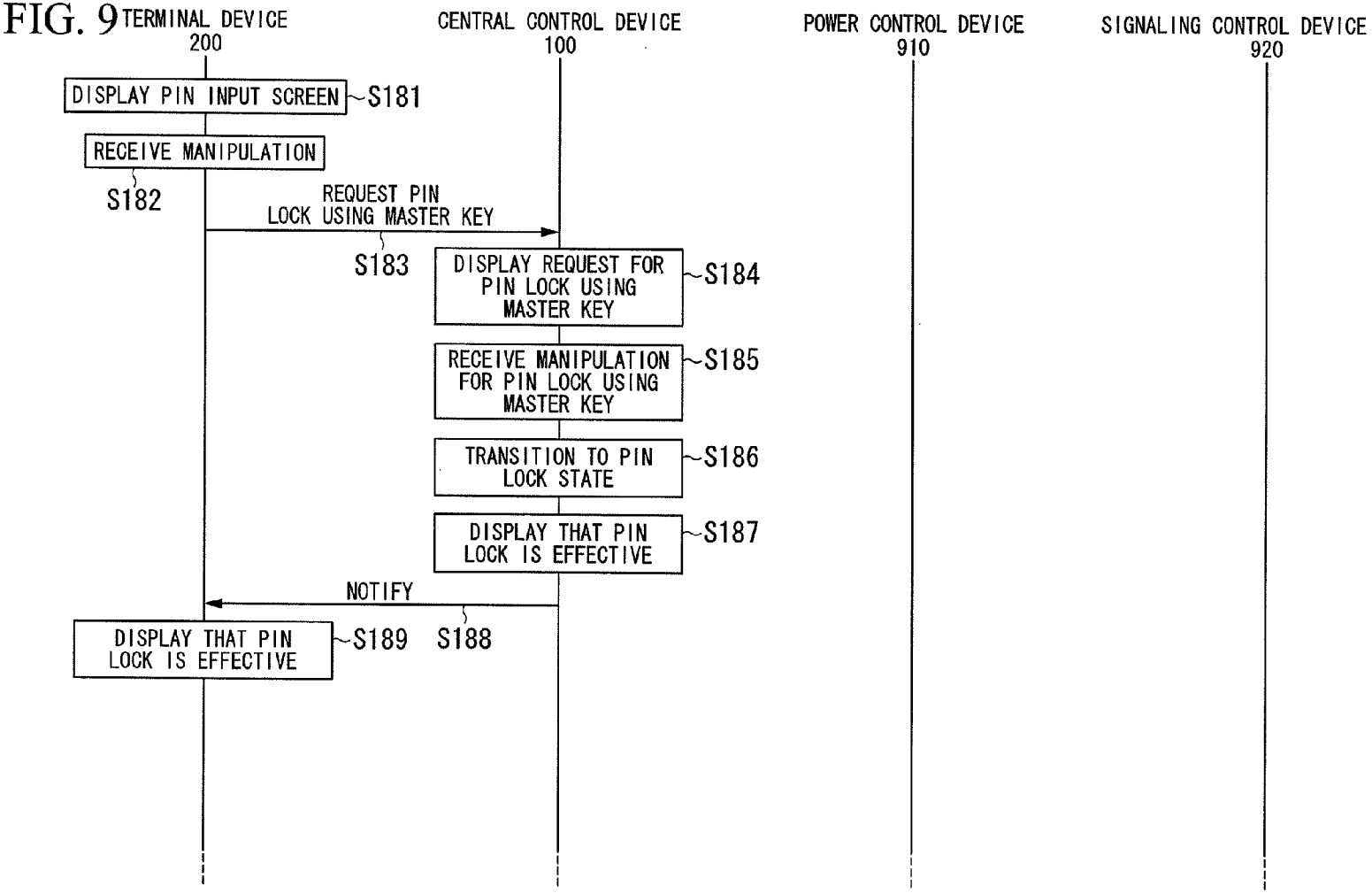
FIG. 9 is a sequence diagram showing an example of operation of the rail transportation control system.

FIG. 9 is a sequence diagram showing an example of operation of the rail transportation control system 1 when the PIN lock is performed by manipulating the central control device 100 after the safety measure is made effective through the series of processes of FIG. 7. Hereinafter, the PIN lock performed by manipulating the central control device 100 is referred to as "PIN lock using a master key."

The sequence S181 is the same as sequence S161 (refer to FIG. 8). However, the display unit 210 displays, on the PIN input screen, a mail transmission button for providing a means for sending E-mail to the ordering person in the operation control center so that the PIN lock is requested without inputting the PIN, in addition to the lock request button B22 described in FIG. 3.

Next, sequence S182 is executed. Specifically, when a authorized person who requests the PIN lock is absent, the worker presses the mail transmission button (e.g., touches the screen) as a manipulation for requesting the PIN lock using the master key. The manipulation input unit 220 receives this button manipulation. Next, sequence S183 is executed, in which the control unit 290 provides the mail transmission means. Specifically, the control unit 290 controls the display unit 210 to display a screen for producing E-mail, and produces the E-mail according to a character input manipulation received by the manipulation input unit 220. When the manipulation input unit 220 receives the E-mail transmission manipulation, the control unit 290 transmits the E-mail to the central control device 100 via the communication unit 230.

A method of making the request for PIN lock using a master key is not limited to a method of using the above-described E-mail transmission. For example, the worker may make a voice call with the ordering person using a telephone device independent from the rail transportation control system 1 to make a request of PIN lock using a master key.

In the central control device 100, sequence S184 is executed. Specifically, when the communication unit 130 receives the E-mail from the terminal device 200, the display unit 110 displays the E-mail to request the ordering person to confirm the E-mail. Accordingly, the request for PIN lock using a master key is displayed.

Then, in sequence S185, the manipulation input unit 120 receives a manipulation for the PIN lock using the master key. Then, in sequence S186, the control unit 190 transitions to the PIN lock state according to the manipulation. For example, the manipulation input unit 120 receives an input of the reference number corresponding to the work order by the ordering person. The control unit 190 rewrites the value of the column for storing the state information in the management data for safety measure described in FIG. 6 from "Execute" to "Lock" according to the reference number corresponding to the work order received by the manipulation input unit 120.

Here, since the PIN lock is a process of maintaining the safety measure, usually, the worker is not in danger even when the PIN lock using the master key is performed. Here, the PIN lock using the master key can be performed by a simple process, compared to release of the PIN lock which will be described later.

Hereinafter, sequences S187 to S189 are the same as the sequences S166 to S168 in FIG. 8.

Thus, the central control device 100 can perform PIN lock by receiving the request for PIN lock using the master key even in a state in which communication is not possible due to failure or battery shortage of the terminal device 200 or poor radio conditions, or when a authorized person making a request for PIN lock is absent. Accordingly, it is possible to reduce the anxiety of the worker and to reduce the possibility of the worker being in danger.

Figure 10:
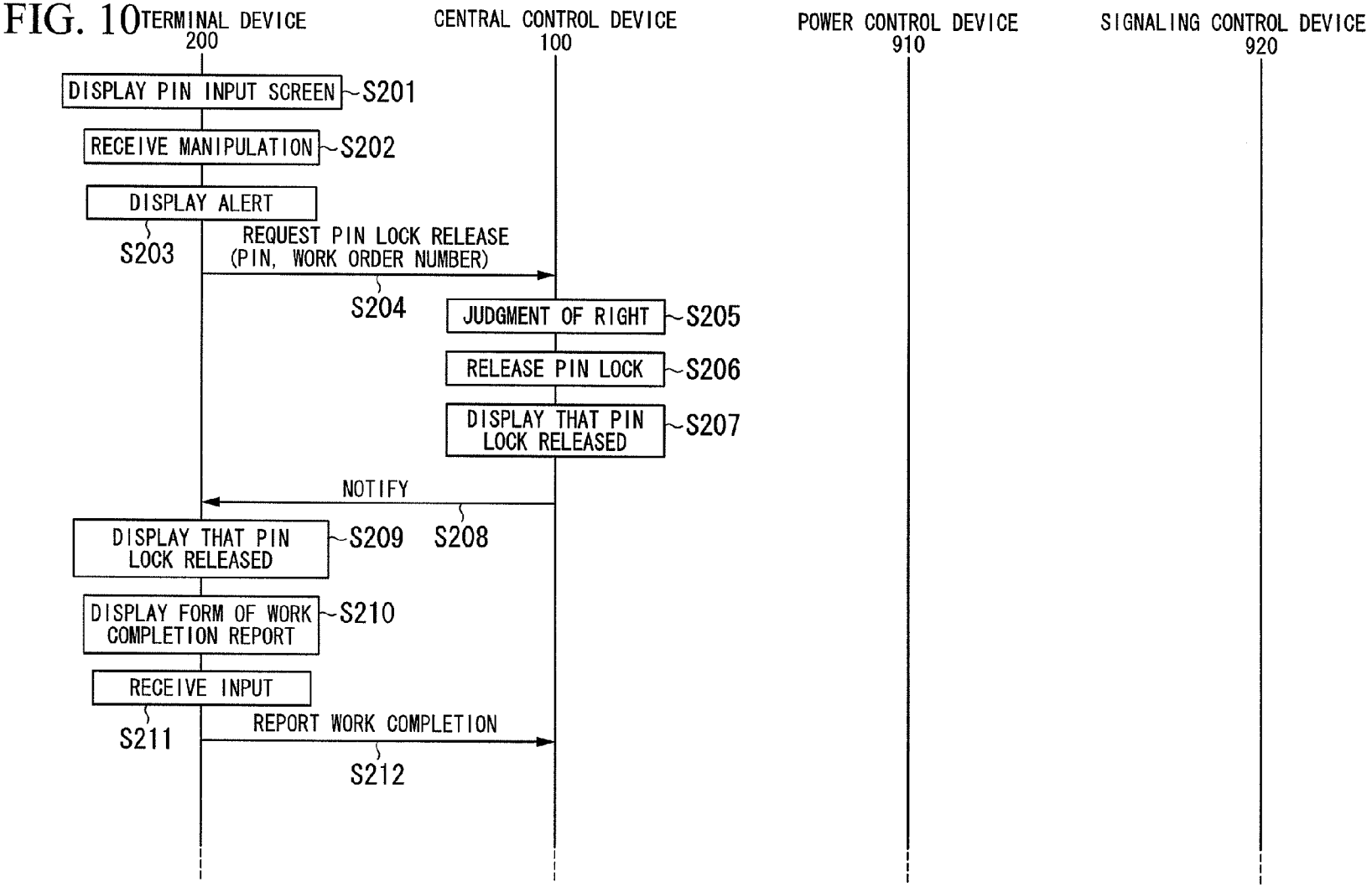
FIG. 10 is a sequence diagram showing an example of operation of the rail transportation control system.

FIG. 10 is a sequence diagram showing an example of operation of the rail transportation control system 1 when the central control device 100 releases the PIN lock in response to the request to release the PIN lock from the terminal device 200 after the PIN lock is made effective by the series of manipulations of FIG. 8 or 9.

First, sequence S201 is executed. Specifically, when the worker completes the maintenance work, the worker makes a request to display a screen for inputting a PIN in order to request the release of the PIN lock. When the manipulation input unit 220 receives this request, the display unit 210 displays the screen for inputting a PIN under control of the control unit 290.

Next, sequence S202 is executed. Specifically, the manipulation input unit 220 receives the PIN and a manipulation for requesting release of the PIN lock, and outputs the PIN input and the request for PIN lock to the control unit 290.

For example, the manipulation input unit 220 receives the PIN input from its keyboard and outputs the PIN to the control unit 290. The control unit 290 controls the display unit 210 to display the PIN in the PIN input area (the area A24 in FIG. 4). The manipulation input unit 220 receives a manipulation of the unlock request button (the button B32 in FIG. 4), and outputs a request to release the PIN lock to the control unit 290.

Next, sequence S203 is executed. Specifically, when the control unit 290 receives the request to release the PIN lock from the manipulation input unit 220, the control unit 290 controls the display unit 210 to display, for a given time, an alert indicating that the safety measure may be released. This display of the alert is performed to allow time to confirm that there is no problem even when the safety measure is released and time to take a measure required for securing safety, as necessary, to the worker.

Next, sequence S204 is executed. Specifically, the control unit 290 generates a request for PIN lock release including the reference number corresponding to the work order included in the work order received in sequence S121 (refer to FIG. 7) and the PIN input in sequence S202, and outputs the request for PIN lock release to the communication unit 230. The communication unit 230 transmits the request for PIN lock release including the reference number corresponding to the work order and the PIN to the central control device 100.

In the central control device 100, sequence S205 is executed. Specifically, the communication unit 130 receives the request for PIN lock release including the reference number corresponding to the work order and the PIN and outputs the request for PIN lock release to the control unit 190. The control unit 190 judges whether the release request is from a person having a right to request a release, based on the reference number corresponding to the work order and the PIN included in the request for PIN lock release.

More specifically, similar to the description in sequence S164 (refer to FIG. 8), the control unit 190 reads a PIN of a person having a right to request PIN lock release from the management data for safety measure stored in the storage unit 140 based on the reference number corresponding to the work order included in the request for PIN lock release. The control unit 190 judges whether the release request is from a person having a right to request PIN lock release based on whether the PIN read from the request for PIN lock release is included in the PIN read from the storage unit 140.

When the control unit 190 judges in sequence S205 that the release request output from the communication unit 130 is from a person having a right to request PIN lock release, sequence S206 is executed. Specifically, the control unit 190 releases the PIN lock by transitioning to an unlock state in which the PIN lock is not performed. The transition to the unlock state is performed by the control unit 190 rewriting the value of the column for storing the state information of the management data for safety measure stored in the storage unit 140 to be "Execute." Here, the above-described "Execute" is a value indicating that the safety measure is being executed, but the PIN lock is not performed.

Next, sequence S207 is executed. Specifically, the control unit 190 controls the display unit 110 to display that the PIN lock has been released after transitioning to the unlock state. The display of the PIN lock being released is performed, for example, by the display unit 110 clearing (not displaying) the icons indicating the PIN lock state (e.g. the icons C412, C423 and C424 in FIG. 5) from the display screen.

Next, sequence S208 is executed. Specifically, further, the control unit 190 outputs information indicating that the PIN lock has been released to the communication unit 130 and the communication unit 130 transmits the information to the terminal device 200.

In the terminal device 200, sequence S209 is executed. Specifically, the communication unit 230 receives the information indicating that the PIN lock has been released and outputs the information to the control unit 290. The control unit 290 controls the display unit 210 to display that the PIN lock has been released. The display that the PIN lock has been released is performed, for example, by the display unit 210 clearing (not displaying) the icons indicating the PIN lock state (icons C412, C423 and C424) when displaying the view of each area in FIG. 5.

After confirming that the PIN lock has been released, the worker performs a manipulation to request to display a form reporting the work completion in the manipulation input unit 220. This form enables the worker to produce a work completion report for the performed maintenance work.

The work completion report includes, for example, items for safety confirmation, such as a check item indicating whether all workers have been evacuated.

Next, sequence S210 is executed. Specifically, when the manipulation input unit 220 receives a manipulation to request to display the form of the work completion report, the control unit 290 reads the form of the work completion report stored in the storage unit 240 in advance in response to the request. The control unit 290 controls the display unit 210 to display the form of the work completion report.

Next, sequence S211 is executed. Specifically, the manipulation input unit 220 receives a manipulation for inputting requirements to a form of the work completion report. The control unit 290 produces the work completion report according to the input manipulation received by the manipulation input unit 220. Next, sequence S212 is executed. Specifically, when the manipulation input unit 220 receives a manipulation to transmit the work completion report, the control unit 290 transmits the produced work completion report to the central control device 100 via the communication unit 230.

As described above, the PIN lock and the release of the PIN lock are, in principle, performed in response to the request from the terminal device 200. However, a case in which communication is not possible due to failure or battery shortage of the terminal device 200 or poor radio conditions may be considered. Also, a case in which a authorized person making a request for PIN lock or PIN lock release is absent is considered. To cope with such cases, exceptionally, the PIN lock or the release of the PIN lock may be performed by manipulating the central control device 100.

Figure 11:
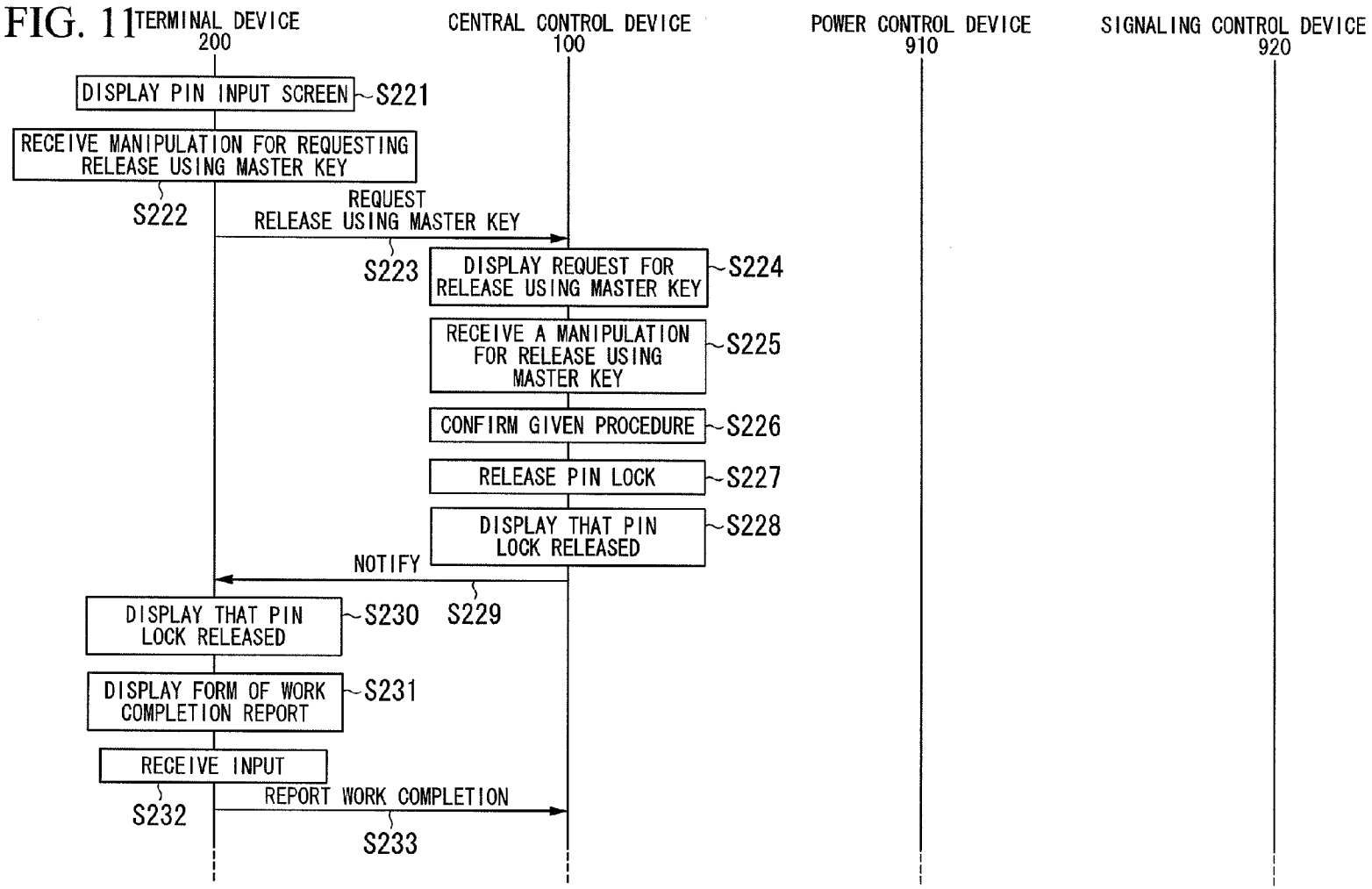
FIG. 11 is a sequence diagram showing an example of operation of the rail transportation control system.

FIG. 11 is a sequence diagram showing an example of operation of the rail transportation control system 1 when the PIN lock is released by manipulating the central control device 100 after the PIN lock is made effective by the series of manipulations of FIG. 8 or 9. Hereinafter, release of the PIN lock performed by manipulating the central control device 100 is referred to as "PIN lock release using master key."

Sequence S221 is the same as sequence S201 (refer to FIG. 10). However, the display unit 210 displays, on a PIN input screen, a mail transmission button providing a mail transmission means for the ordering person in the operation control center in order to request the release of the PIN lock without inputting the PIN, in addition to the button B32 for requesting lock release described in FIG. 4.

Next, sequence S222 is executed. Specifically, when a authorized person who requests the release of the PIN lock is absent, the worker presses the mail transmission button (e.g., touches the screen) as a manipulation for a request for PIN lock release using a master key. The manipulation input unit 220 receives this manipulation. Subsequently, sequence S223 is executed, and the control unit 290 provides the mail transmission means, similar to the description in sequence S183 (refer to FIG. 9).

Also, a method of making a request to release the PIN lock using the master key is not limited to a method of using the above-described E-mail transmission. For example, the worker may make a voice call with the ordering person using a telephone device independent from the rail transportation control system 1, to request the release of the PIN lock using a master key.

In the central control device 100, sequence S224 is executed. Specifically, when the communication unit 130 receives the E-mail from the terminal device 200, the display unit 110 displays the E-mail to request the ordering person to confirm the E-mail. Accordingly, the PIN lock release request using the master key is displayed.

Then, in sequence S225, the manipulation input unit 120 receives the manipulation for PIN lock release using the master key. Then, in sequence S226, the control unit 190 performs a process of confirming that a given procedure is executed. The given procedure cited herein is a procedure of confirming that a risk is not generated even when the PIN lock is released and the safety measure is released.

For example, the control unit 190 reads a message "Send staff and confirm safety of the worksite, please." stored in the storage unit 140 in advance, and controls the display unit 110 to display this message. The ordering person reading this message goes to the maintenance work area or contacts a work base closest to the maintenance work area through a telephone to request safety confirmation. After the safety confirmation is completed, the ordering person performs a manipulation for indicating completion of the safety confirmation in the manipulation input unit 120.

Next, sequence S227 is executed. After confirming that the given procedure has been executed, the control unit 190 releases the PIN lock state. For example, in a release manipulation in sequence S225, the manipulation input unit 120 receives an input of the reference number corresponding to the work order by the ordering person, and the control unit 190 rewrites the value of the column for storing the state information in the management data for safety measure described in FIG. 6 from "Lock" to "Execute" according to the reference number corresponding to the work order.

Hereinafter, sequences S228 to S233 are the same as sequences S207 to S212 in FIG. 10.

Thus, the central control device 100 receives a request for PIN lock release using the master key. This enables the PIN lock to be released even in a state in which communication is not possible due to failure or battery shortage of the terminal device 200 or poor radio conditions, or when a authorized person making a request for PIN lock release is absent. The safety measure can be released according to the release of the PIN lock, such that the rail transportation control system 1 can be restored.

Figure 12:
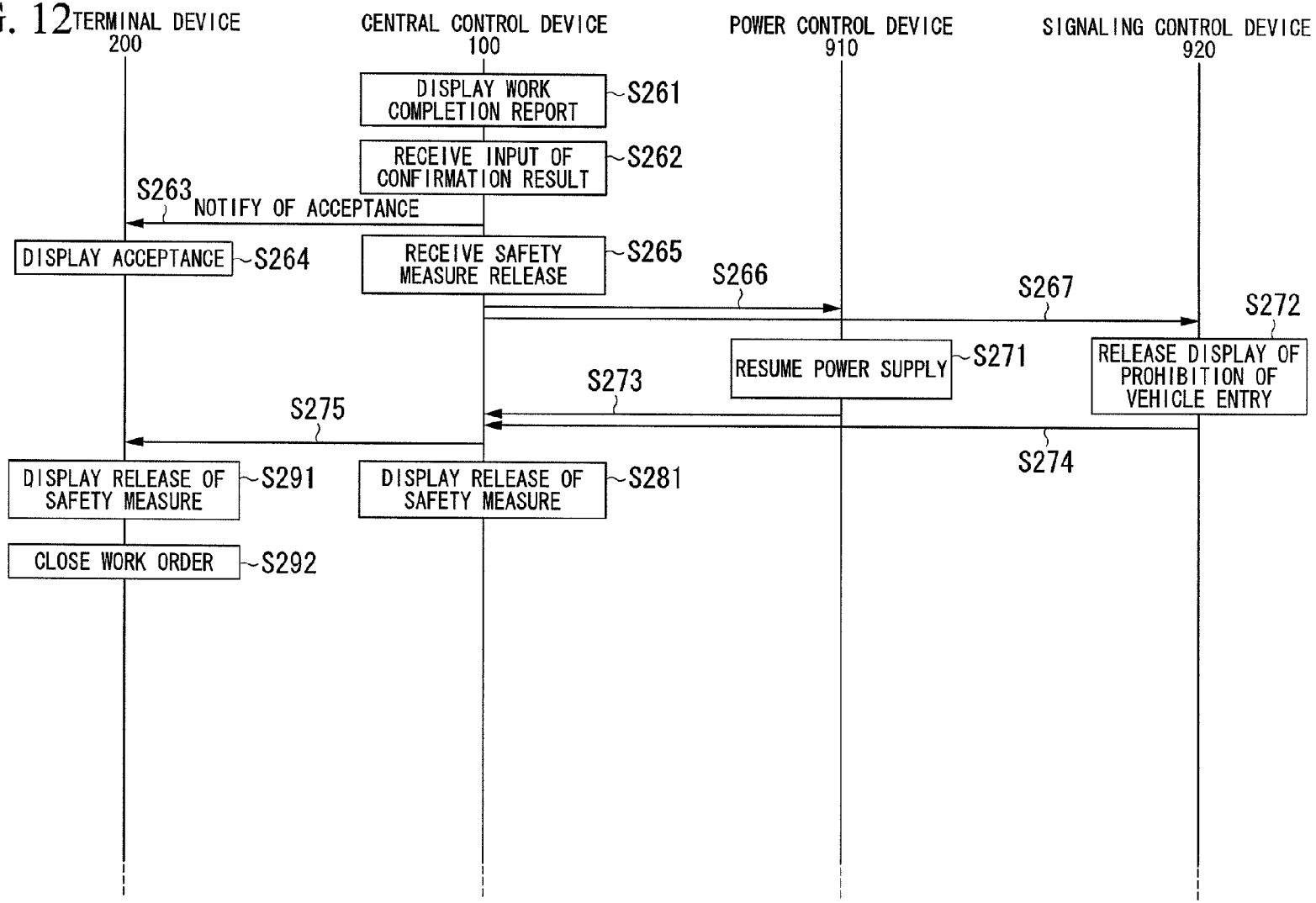
FIG. 12 is a sequence diagram showing an example of operation of the rail transportation control system.

FIG. 12 is a sequence diagram showing an example of operation of the rail transportation control system 1 when the central control device 100 releases the safety measure after the PIN lock is released by the series of manipulations in FIG. 10 or 11.

In sequence S212 of FIG. 10 or sequence S233 of FIG. 11, when the communication unit 130 receives the transmitted work completion report, the control unit 190 controls the display unit 110 to display the work completion report, as shown as sequence S261.

As described above, the safety confirmation item is included in the work completion report. Thus, the ordering person may perform safety confirmation by referencing the displayed work completion report, and judge whether the safety measure is allowed to be released. Here, the ordering person confirms the work completion report displayed by the display unit 110, judges whether there is no problem, and performs an input manipulation for the confirmation result (the result of judging whether there is no problem) in the manipulation input unit 120. In the example of FIG. 12, in sequence S262, the manipulation input unit 120 receives a manipulation for inputting the confirmation result indicating that there is no problem.

Next, sequence S263 is executed. Specifically, the control unit 190 generates an acceptance notification for the work completion report, which is a notification indicating that there is no problem in the work completion report, based on the input manipulation received by the manipulation input unit 120, and outputs the acceptance notification to the communication unit 130. The communication unit 130 transmits this acceptance notification to the terminal device 200.

The terminal device 200 executes sequence S264. Specifically, the communication unit 230 receives the acceptance notification from the central control device 100, and the control unit 290 displays the acceptance notification on the display unit 210.

Next, sequence S265 is executed. Specifically, the manipulation input unit 120 receives an input manipulation for instructing the release of the safety measure from the ordering person having confirmed the safety, based on the work completion report. The manipulation input unit 120 outputs information indicating the received input manipulation to the control unit 190. For example, the manipulation input unit 120 has, in each given section, a push button for instructing resumption of power supply, and receives pressing of the push button. The manipulation input unit 120 outputs information for instructing resumption of power supply to the section corresponding to the pressed push button, to the control unit 190. The manipulation input unit 120 has, in each given section, a push button for instructing to release vehicle entry prohibition, and receives pressing of the push button. The manipulation input unit 120 outputs information for instructing to release vehicle entry prohibition into the section corresponding to the pressed push button, to the control unit 190.

In the example of FIG. 12, the ordering person presses the push button for instructing resumption of power supply to the maintenance work area and the push button for instructing to release prohibition of vehicle entry into the maintenance work area. The manipulation input unit 120 outputs the information indicating resumption of power supply to the maintenance work area and information for instructing to release prohibition of vehicle entry into the maintenance work area to the control unit 190.

The control unit 190 controls the target device 900 to release the first state and enter a normal state (i.e., releases the safety measure) according to the information output from the manipulation input unit 120. In this case, the control unit 190 judges whether the PIN lock for the safety measure as a release target is released for all maintenance works by referencing the management data for safety measure stored in the storage unit 140, and releases the safety measure only when it is judged that the PIN lock has been released in all the maintenance works.

That is, when a plurality of maintenance works are performed, the safety measure needs to be continued to secure the safety of the worker when the PIN lock is made effective in other maintenance works even when the PIN lock is released in one maintenance work. Here, the control unit 190 releases the safety measure only when the PIN lock is released in all the maintenance works.

Specifically, the control unit 190 acquires information indicating resumption of power supply to the maintenance work area. Then, the control unit 190 judges whether there is a row whose value of the column for storing the state information is "locked" for the stop of power supply to the maintenance work area indicated by the acquired information, by referencing the management data for safety measure. For example, there is a case in which the safety measure 3 in FIG. 6 corresponds to the stop of the power supply to the maintenance work area. In this case, the control unit 190 judges whether there is a column whose value is "Lock" by referencing all the columns for storing the state information in the column of this safety measure 3.

When it is judged that there is no row whose value is "locked," the control unit 190 performs a process of resuming the power supply. On the other hand, when it is judged that there is a row whose value is "locked," for example, the control unit 190 performs a next process. The control unit 190 controls the display unit 110 to display the reference number corresponding to the work order at a row whose value is "Lock" and a message indicating that the safety measure cannot be released.

When the control unit 190 judges that there is no row whose value is "locked," sequence S266 is executed. Specifically, the control unit 190 transmits control information for instructing the power control device 910 to resume power supply to the maintenance work area, to the power control device 910 via the control information communication unit 150. Sequence S271 is executed according to this control information. Specifically, the power control device 910 resumes power supply to the designated section (maintenance work area) according to the control information transmitted by the control unit 190.

Similarly, the control unit 190 acquires the information for instructing to release prohibition of vehicle entry into the maintenance work area. The control unit 190 then references the management data for safety measure. The control unit 190 judges whether there is a row whose value of the column for storing the state information is "locked" for prohibition of vehicle entry into the maintenance work area indicated by the acquired information.

When the control unit 190 judges that there is no row whose value is "locked," sequence S267 is executed. Specifically, the control unit 190 transmits control information, for instructing the signaling control device 920 to release signal display for prohibiting vehicle entry into the maintenance work area, to the signaling control device 920 via the control information communication unit 150. Sequence S272 is executed according to this control information. Specifically, the signaling control device 920 releases control to instruct the signaling device as the control target to display a signal for prohibiting vehicle entry into the designated section (the maintenance work area) according to the control information transmitted from the control unit 190.

Next, sequence S273 is executed. Specifically, the power control device 910 having completed the process of resuming power supply to the designated section in sequence S271 outputs information indicating that the power supply has been resumed to the central control device 100. Similarly, sequence S274 is executed. Specifically, the signaling control device 920 having completed the process of releasing signal display for prohibiting vehicle entry into the designated section in sequence S272 outputs information indicating that vehicle entry prohibition has been released, to the central control device 100.

In the central control device 100, sequence S275 is executed. Specifically, the control unit 190 acquires the information transmitted from the target device 900, via the control information communication unit 150. The control unit 190 transmits the information indicating that the safety measure has been released, to the terminal device 200 via the communication unit 130 based on the acquired information.

In the terminal device 200, sequence S291 is executed. Specifically, the communication unit 230 receives the information from the control unit 190 and outputs the information to the control unit 290, and the control unit 290 displays that the safety measure has been released, on the display unit 210.

Further, in sequence S281, the control unit 190 displays that the safety measure has been released, on the display unit 110. This display that the safety measure has been released is performed, for example, by restoring the brightness of the route to normal brightness and deleting the × icon such as the icon C411 (not displaying) on the screen shown in FIG. 5.

The control unit 190 then controls the display unit 210 to close the display window of the work order according to the manipulation received by the manipulation input unit 220.

Next, an operation of the central control device 100 will be described with reference to FIGS. 13 to 18. FIGS. 13 to 18 are flowcharts showing a process procedure performed by the central control device 100.

Figure 13:
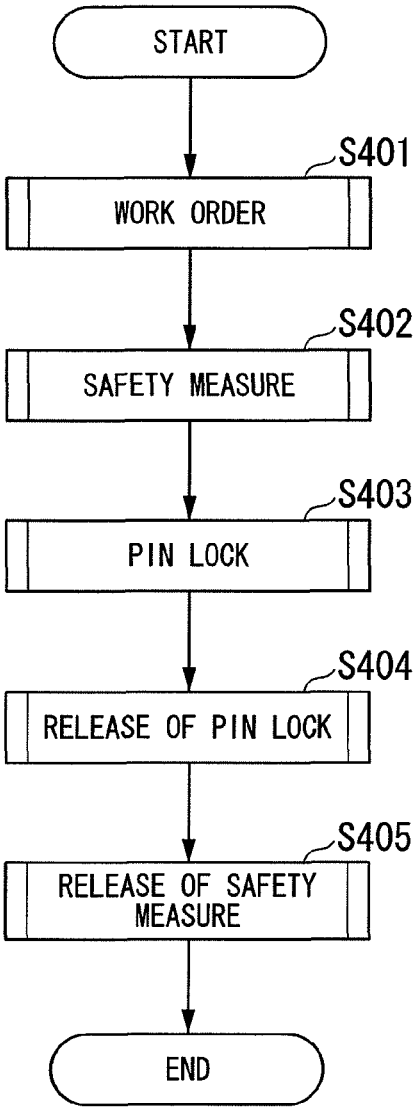
FIG. 13 is a flowchart showing a process procedure performed by the central control device of the embodiment.

FIG. 13 is a flowchart showing an overview of a process procedure performed by the central control device 100. The central control device 100 performs the process of FIG. 13 for each maintenance work when the maintenance work is necessary due to an accident or regularly scheduled maintenance.

First, in step S401, the central control device 100 produces a work order according to the manipulation of the ordering person and transmits the work order to the terminal device 200. Next, in step S402, the central control device 100 executes the safety measure according to the approval request transmitted from the terminal device 200. Then, in step S403, the central control device 100 performs PIN lock in response to the request for PIN lock transmitted from the terminal device 200 or PIN lock using the master key. In step S404, the central control device 100 releases the PIN lock in response to the request for PIN lock release transmitted from the terminal device 200 after maintenance work completion or PIN lock release using the master key. Then, in step S405, the central control device 100 releases the safety measure.

Figure 14:
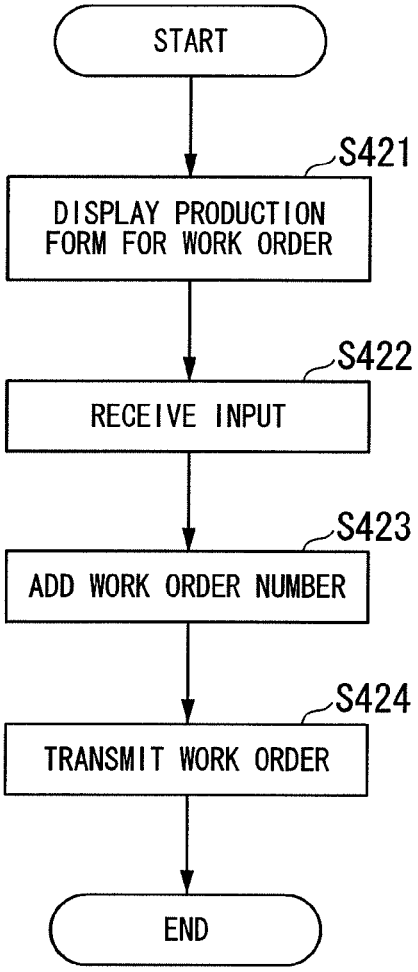
FIG. 14 is a flowchart showing a process procedure performed by the central control device of the embodiment.

FIG. 14 is a flowchart showing a process procedure in which the central control device 100 produces a work order according to a manipulation of the ordering person and transmits the work order to the terminal device 200. The process of FIG. 14 is performed in step S401 (refer to FIG. 13).

First, step S421 is executed. Specifically, in the central control device 100, when the manipulation input unit 120 receives a request to display a production form for the work order from the ordering person, the control unit 190 reads the production form for the work order stored in the storage unit 140 and displays the production form on the display unit 110. This process corresponds to the process of sequence S101 (refer to FIG. 7).

Next, in step S422, the manipulation input unit 120 receives a manipulation by the ordering person for inputting requirements to the production form for the work order displayed by the display unit 110. PINs of a person having a right to make a request for PIN lock and a person having a right to make a request for PIN lock release are included in the requirements received by the manipulation input unit 120. The person having a right to make a request for PIN lock and the person having a right to make a request for PIN lock release may be one person or a plurality of persons. Further, the person having a right to make a request for PIN lock and the person having a right to make a request for PIN lock release may be the same or different.

In step S423, the control unit 190 produces the work order according to the input manipulation received by the manipulation input unit 120, adds the reference number corresponding to the work order to the produced work order, and outputs the resultant work order to the communication unit 130. The process of steps S422 and S423 corresponds to the process of sequence S102.

In step S424, the communication unit 130 transmits the work order output from the control unit 190 together with the number of the work number to the communication unit 230 of the terminal device 200. Here, the control unit 190 transmits the work order together with the reference number corresponding to the work order to the terminal device 200 held by the person having a right to make a request for PIN lock and the person having a right to make a request for PIN lock release, based on the PIN input in step S422. Even in the following description, transmission from the control unit 190 to the terminal device 200 is performed on the terminal device 200 held by the person having a right to make a request for PIN lock and the person having a right to make a request for PIN lock release. The process of step S402 corresponds to the process of sequence S103.

Then, the process in FIG. 14 ends and the procedure proceeds to step S402 (refer to FIG. 13).

Figure 15:
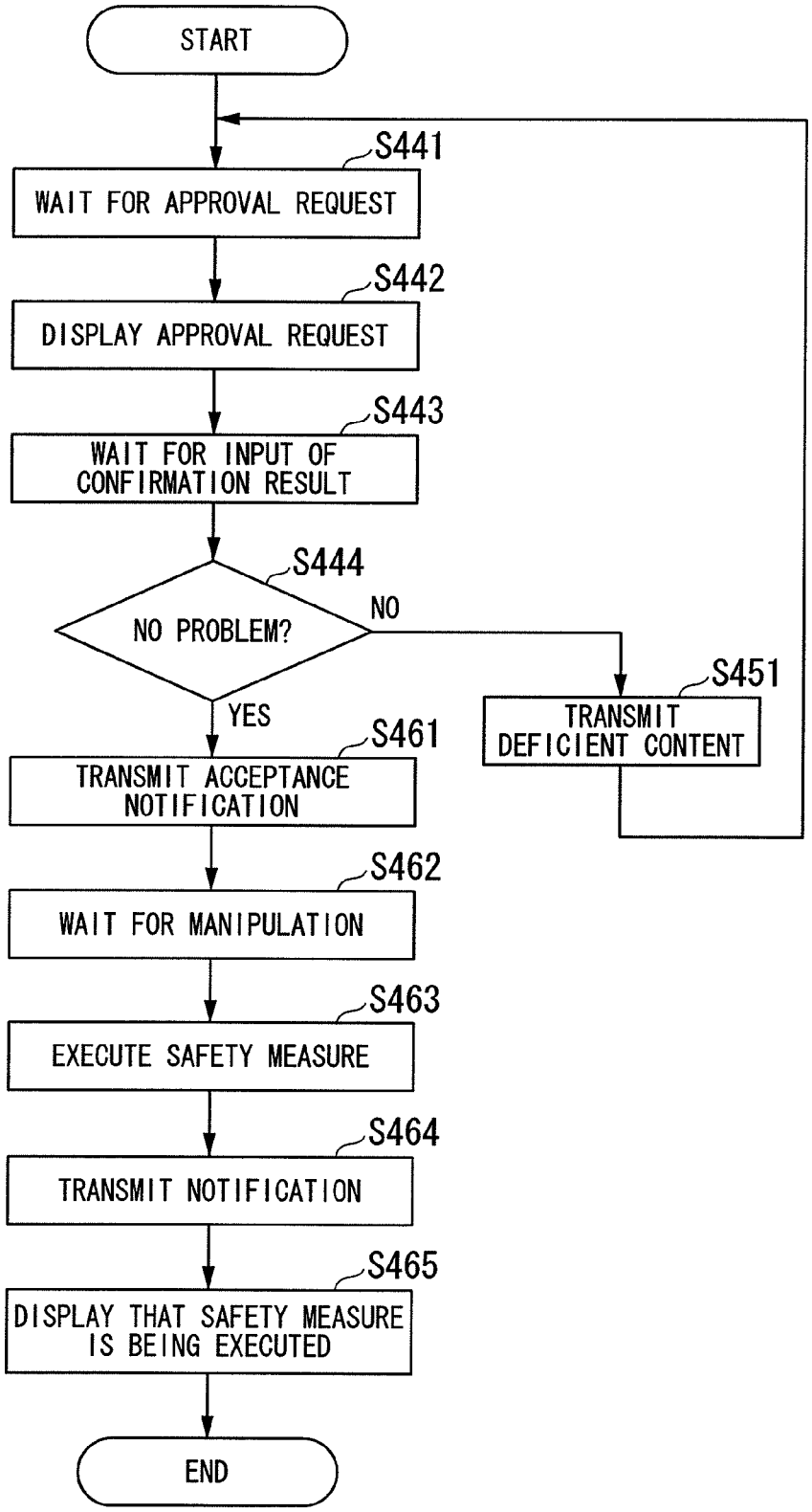
FIG. 15 is a flowchart showing a process procedure performed by the central control device of the embodiment.

FIG. 15 is a flowchart showing a process procedure in which the central control device 100 performs a safety measure. The process in FIG. 15 is performed in step S402 (refer to FIG. 13).

First, in step S441, the communication unit 130 waits for the approval request to be transmitted from the terminal device 200. In step S442, when the communication unit 130 receives the approval request from the terminal device 200, the control unit 190 displays the approval request on the display unit 110. The process of steps S441 and S442 corresponds to the process of sequence S125 (refer to FIG. 7).

Then, in step S443, the manipulation input unit 120 waits for a manipulation by the ordering person for inputting the result of confirming the approval request. This process corresponds to the process of sequence S126.

When the manipulation input unit 120 receives the input manipulation for the confirmation result, the control unit 190 judges whether there is a problem in the input confirmation result in step S444. For example, when the ordering person inputs "OK" using the keyboard included in the manipulation input unit 120, the control unit 190 judges that there is no problem in the confirmation result. That is, the judgment in step S444 is YES. On the other hand, when the ordering person inputs "NG" and then inputs deficient content, the control unit 190 judges that the confirmation result has a problem. That is, the judgment in step S444 is NO.

When the control unit 190 determines in step S444 that the confirmation result has a problem, that is, when the judgment in step S444 is NO, the control unit 190 outputs the deficient content included in the confirmation result to the communication unit 130 in step S451. The communication unit 130 transmits the deficient content to the terminal device 200. Then, the procedure returns to step S441, in which the communication unit 130 waits for the approval request to be retransmitted from the terminal device 200.

On the other hand, when the control unit 190 judges in step S444 that the confirmation result has no problem, that is, when the judgment in step S444 is YES, the control unit 190 outputs an acceptance notification indicating that there is no problem in the approval request to the communication unit 130. In step S461, the communication unit 130 transmits the acceptance notification to the terminal device 200. This process corresponds to the process of sequence S127.

Then, in step S462, the manipulation input unit 120 waits for a manipulation by the ordering person for instructing execution of safety measure. When the manipulation input unit 120 receives the input manipulation for instructing execution of the safety measure, the manipulation input unit 120 outputs information indicating the received input manipulation to the control unit 190. This process corresponds to the process of sequence S141.

In step S463, the control unit 190 controls the target device 900 to enter the first state in which the maintenance work is safely performed (i.e., executes the safety measure) according to the information output from the manipulation input unit 120. This process corresponds to the process of sequences S142 to S145.

Then, in step S464, the control unit 190 detects that the safety measure is made effective based on the information transmitted from the target device 900, and transmits information, indicating that the safety measure is made effective, to the terminal device 200 via the communication unit 130. This process corresponds to the process of sequence S148.

Further, in step S465, the control unit 190 displays that the safety measure is being executed, on the display unit 110. This process corresponds to the process of sequence S152.

Then, the process of FIG. 15 ends and the procedure proceeds to step S403 (refer to FIG. 13).

Figure 16:
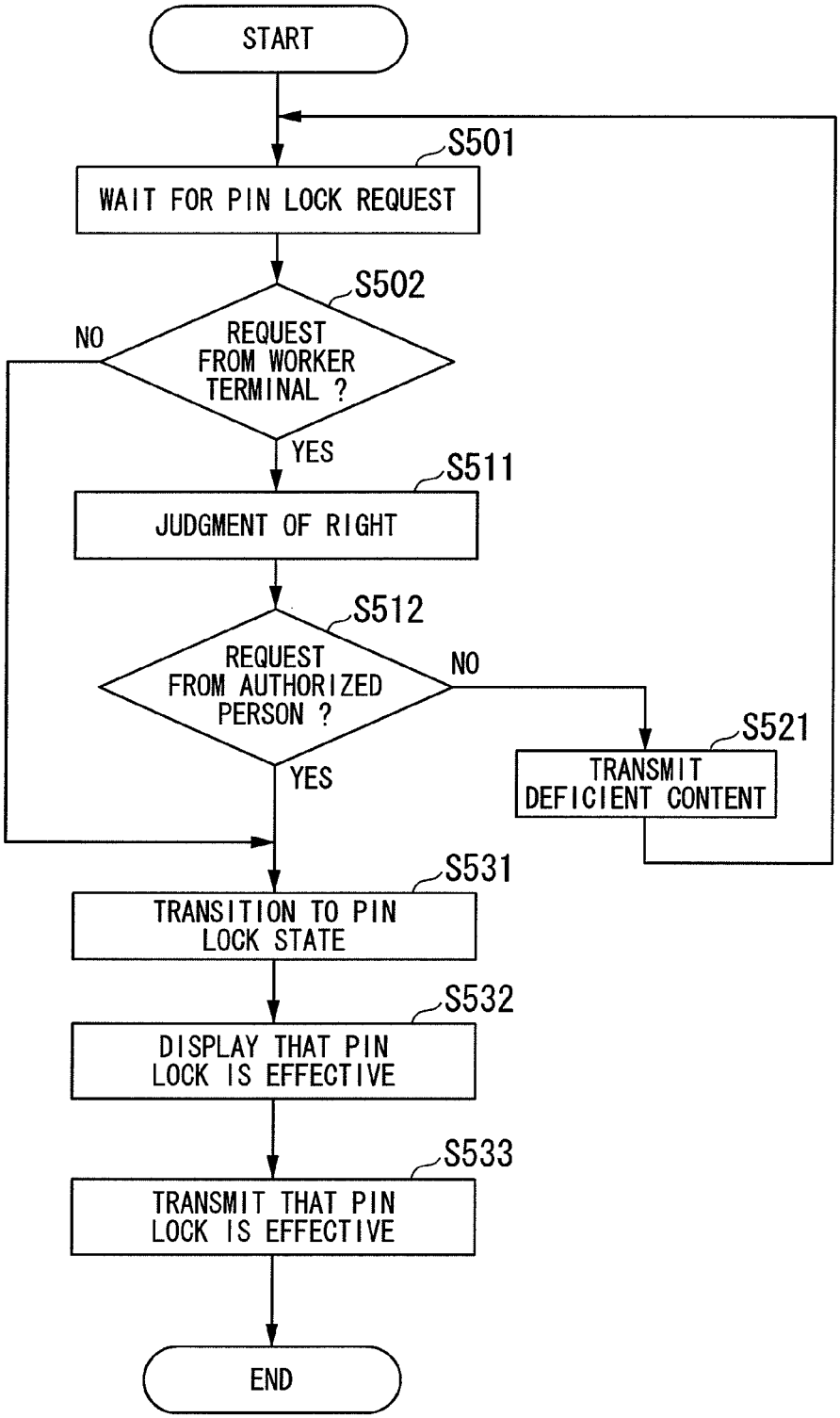
FIG. 16 is a flowchart showing a process procedure performed by the central control device of the embodiment.

FIG. 16 is a flowchart showing a process procedure in which the central control device 100 performs PIN lock. The process in FIG. 16 is performed in step S403 (refer to FIG. 13).

First, in step S501, the communication unit 130 receives a request for PIN lock from the terminal device 200. When the communication unit 130 receives the request for PIN lock from the terminal device 200, the communication unit 130 outputs the request for PIN lock to the control unit 190. Meanwhile, the manipulation input unit 120 receives a manipulation using a master key for requesting the PIN lock. When the manipulation input unit 120 receives the manipulation for requesting the PIN lock using the master key, the manipulation input unit 120 outputs the request for PIN lock using a master key to the control unit 190. Also, reception and display of the E-mail described in sequence S184 (refer to FIG. 9) are also performed in step S501.

When the control unit 190 receives the request for PIN lock from the communication unit 130 or the manipulation input unit 120, step S502 is executed. Specifically, the control unit 190 judges whether the request for PIN lock is output from the communication unit 130, that is, the request for PIN lock is transmitted from the terminal device 200 carried by the worker. When it is judged in step S502 that the request for PIN lock is output from the communication unit 130, that is, when the judgment in step S502 is YES, steps S511 and S512 are executed. Specifically, the control unit 190 performs a process such as, for example, reading the reference number corresponding to the work order from the request for PIN lock and acquires the PIN from the storage unit 240, as described in sequence S164 (refer to FIG. 8). Thus, the control unit 190 performs a process of judging whether the request for PIN lock is from the person having a right to request PIN lock based on the reference number corresponding to the work order and the PIN included in the request for PIN lock.

When it is judged in step S512 that the request for PIN lock is not from the person having a right to request the PIN lock, that is, when the judgment in step S512 is NO, the control unit 190 outputs deficient content, indicating that there is no right to request the PIN lock, to the communication unit 130. The communication unit 130 transmits the deficient content to the terminal device 200 that is a transmission source for the request for PIN lock.

Then, the procedure returns to step S501, the communication unit 130 waits for a request for PIN lock again.

On the other hand, when it is judged in step S512 that the request for PIN lock is from the person having a right to request PIN lock, that is, when the judgment in step S512 is YES, step S531 is executed. Specifically, the control unit 190 transitions to a PIN lock state. This process corresponds to the process of sequence S165 (refer to FIG. 8).

Then, the control unit 190 controls the display unit 110 to display that the PIN lock is made effective in step S532. This process corresponds to the process of sequence S166.

Further, in step S533, the control unit 190 outputs information indicating that the PIN lock is made effective, to the communication unit 130, and the communication unit 130 transmits the information to the terminal device 200. This process corresponds to the process of sequence S167.

Then, the process in FIG. 16 ends and the procedure proceeds to step S404 (refer to FIG. 13).

On the other hand, when it is judged in step S502 that the request for PIN lock has been output from the manipulation input unit 120, that is, when the judgment in step S502 is NO, the procedure proceeds to step S531. That is, since the PIN lock using the master key is requested, the central control device 100 performs the PIN lock based on the request.

Figure 17:
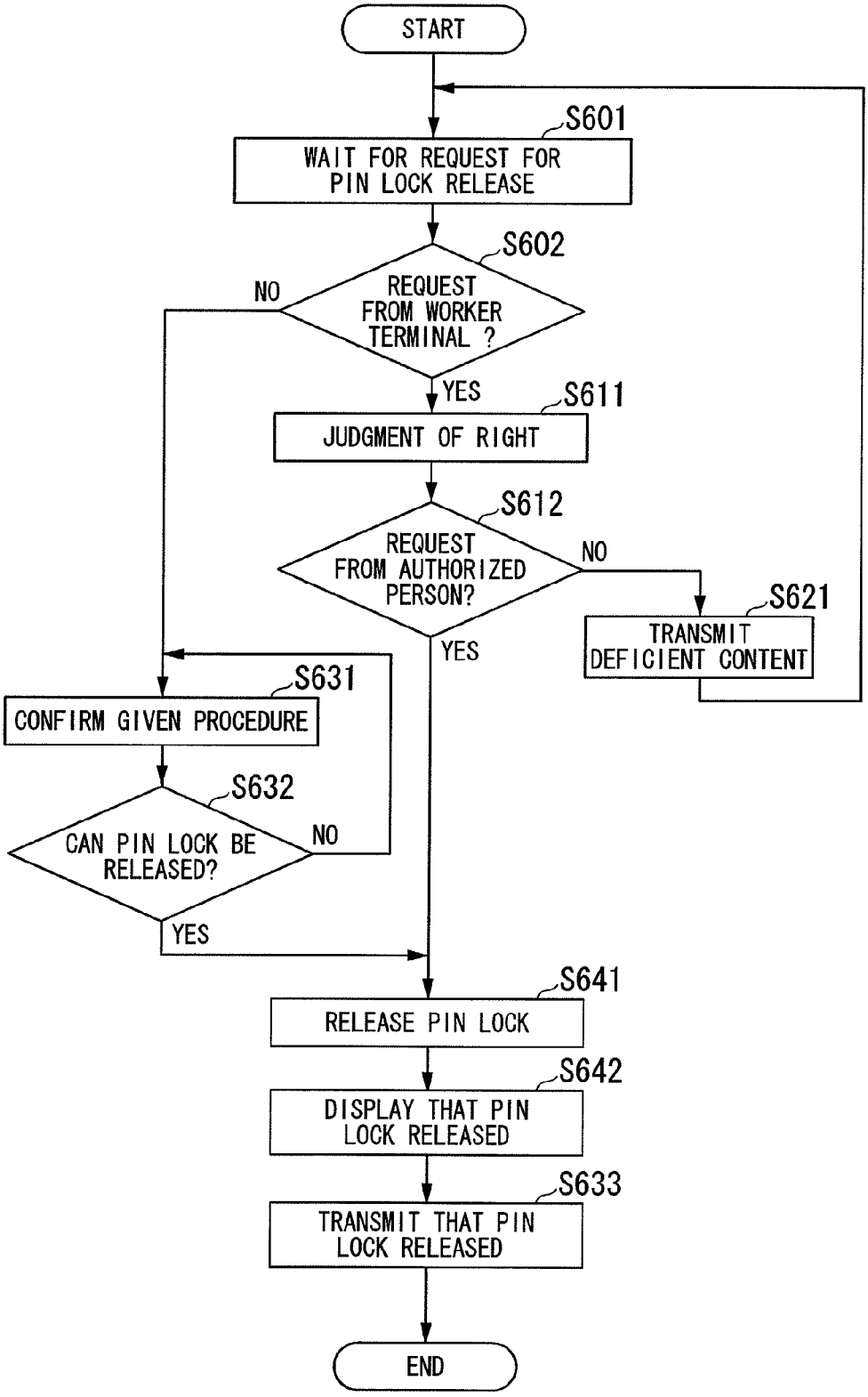
FIG. 17 is a flowchart showing a process procedure performed by the central control device of the embodiment.

FIG. 17 is a flowchart showing a process procedure in which the central control device 100 performs release of the PIN lock. The process in FIG. 17 is performed in step S404 (refer to FIG. 13).

First, the communication unit 130 waits for a request for PIN lock release from the terminal device 200. When the communication unit 130 receives the request for PIN lock release from the terminal device 200, the communication unit 130 outputs the release request to the control unit 190. On the other hand, the manipulation input unit 120 waits for a manipulation for a request for PIN lock release using a master key.

In step S601, when the manipulation input unit 120 receives the manipulation for a request for PIN lock release using a master key, the manipulation input unit 120 outputs the release request using the master key to the control unit 190. Also, the E-mail reception and display described in sequence S222 (refer to FIG. 11) are performed in step S601.

In step S602, the control unit 190 receives the request for PIN lock release from the communication unit 130 or the manipulation input unit 120. Then, the control unit 190 judges whether the request for PIN lock release is output from the communication unit 130, that is, the release request is transmitted from the terminal device 200 carried by the worker. When it is judged the release request is output from the communication unit 130, that is, when the judgment in step S602 is YES, steps S611 and S612 are executed. Specifically, the control unit 190 reads the reference number corresponding to the work order from the release request and acquires a PIN from the storage unit 240, similar to the description of sequence S164 (refer to FIG. 8). Thus, the control unit 190 performs a process of judging whether the release request is from a person having a right to request the release based on the reference number corresponding to the work order and the PIN included in the release request.

When it is judged that the release request is not from the person having a right to request the release, that is, when the judgment in step S612 is NO, step S621 is executed. Specifically, the control unit 190 outputs deficient content, indicating that there is no right to request the release, to the communication unit 130. The communication unit 130 transmits the deficient content to the terminal device 200, which is a transmission source for the release request.

Then, the procedure returns to step S601, in which the communication unit 130 waits for the release request again.

On the other hand, when it is judged in step S612 that the release request is from a person having a right to request the release, that is, when the judgment in step S612 is YES, step S641 is executed. Specifically, the control unit 190 releases the PIN lock. This process corresponds to the process of sequence S206 (refer to FIG. 10).

Then, in step S642, the control unit 190 controls the display unit 110 to display that the PIN lock has been released. This process corresponds to the process of sequence S207.

Further, in step S643, the control unit 190 outputs information indicating that the PIN lock has been released, to the communication unit 130, and the communication unit 130 transmits the information to the terminal device 200. This process corresponds to the process of sequence S208.

Then, the process in FIG. 17 ends, and the procedure proceeds to step S405 (refer to FIG. 13).

On the other hand, when it is judged in step S602 that the release request has been output from the manipulation input unit 120, that is, when the judgment in step S602 is NO, step S631 is executed. Specifically, the control unit 190 performs a process of confirming that a given procedure is executed, as described in sequence S226.

In step S632, the control unit 190 judges whether the PIN lock can be released, based on whether the safety has been confirmed through the confirmation process of step S631. For example, the control unit 190 judges whether the PIN lock can be released based on whether there is a safety confirmation completion manipulation by the ordering person, as described in sequence S226.

When it is judged that the PIN lock can be released, that is, when the judgment in step S632 is NO, the procedure returns to step S631 to wait for the safety confirmation completion. On the other hand, when it is judged that the PIN lock can be released, that is, when the judgment in step S632 is YES, the procedure proceeds to step S641 in which the PIN lock is released.

Figure 18:
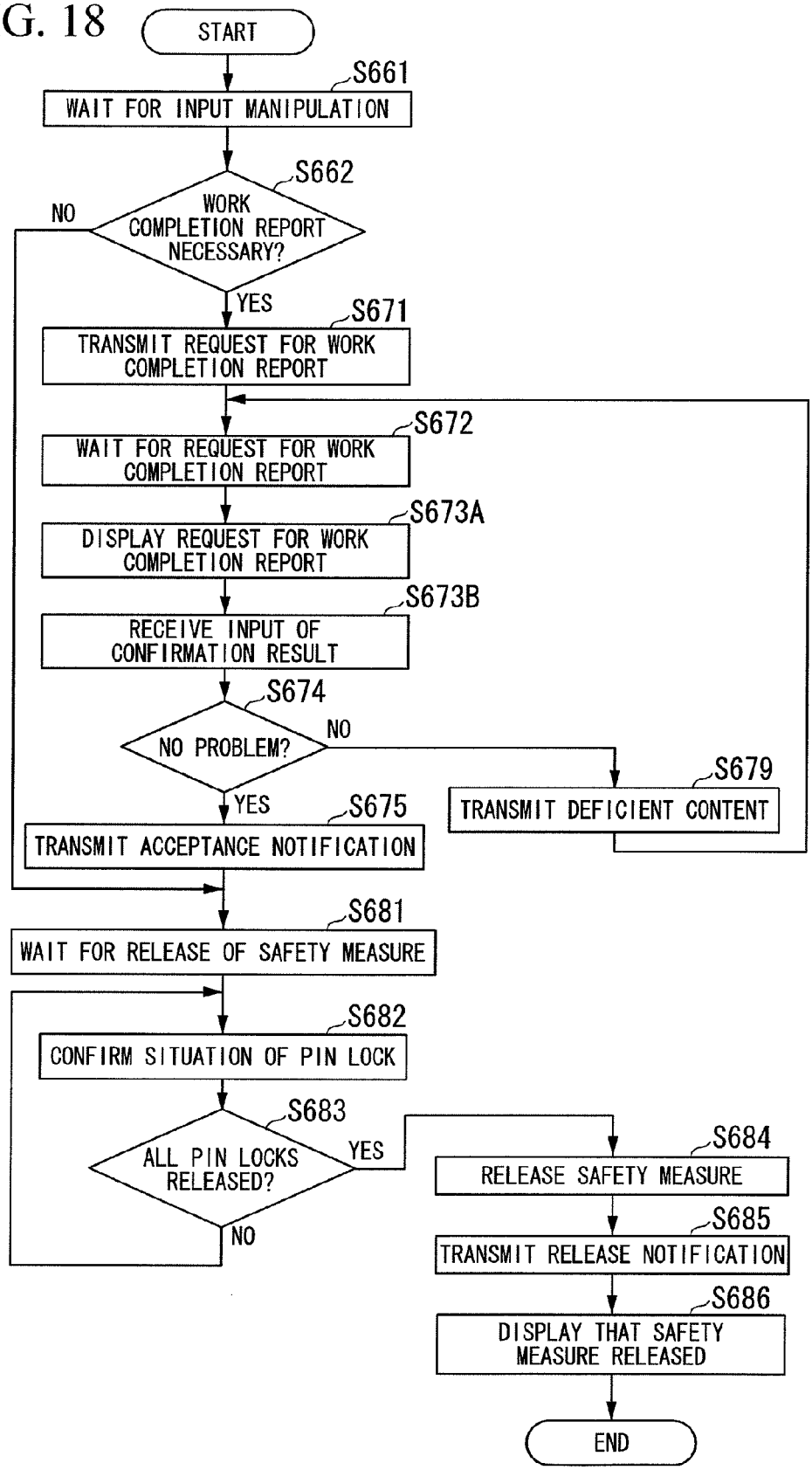
FIG. 18 is a flowchart showing a process procedure performed by the central control device of the embodiment.

FIG. 18 is a flowchart showing a process procedure in which the central control device 100 performs release of the safety measure. The process of FIG. 18 is performed in step S405 (refer to FIG. 13).

First, in step S661, the manipulation input unit 120 waits for an input manipulation from the ordering person indicating whether a work completion report is necessary. Although the case in which the work completion report is performed has been described in FIG. 12, a case in which such a report is unnecessary may also be considered. For example, in maintenance work spanning several days, the work completion report of a final day may be requested but the work completion report of other days may not be requested. Thereby, the manipulation input unit 120 waits for the ordering person to input a manipulation indicating whether the work completion report is necessary.

When the manipulation input unit 120 receives the input manipulation indicating whether the work completion report is necessary, the manipulation input unit 120 outputs information indicating whether the work completion report is necessary, to the control unit 190. In step 662, the control unit 190 judges whether the work completion report is necessary based on the information indicating whether the work completion report is necessary.

When the control unit 190 judges that the work completion report is unnecessary, that is, when the judgment in step S662 is NO, the procedure proceeds to step S681, in which a process of releasing the safety measure, which will be described later, is performed.

When the control unit 190 judges that the work completion report is necessary, that is, when the judgment in step S662 is YES, step S671 is executed. Specifically, the control unit 190 transmits information indicating that the work completion report is necessary to the terminal device 200 via the communication unit 130.

In step S672, the communication unit 130 waits for the work completion report to be transmitted from the terminal device 200.

When the communication unit 130 receives the work completion report, the control unit 190 controls the display unit 110 to display the work completion report in step S673A. This process corresponds to the process of the sequence S261 (refer to FIG. 12).

Then, in step 673B, the manipulation input unit 120 waits for a manipulation by the ordering person for inputting the result of confirming the work completion report. This process corresponds to the process of sequence S262.

When the manipulation input unit 120 receives the input manipulation for the confirmation result, the control unit 190 judges that there is no problem in the confirmation result in step S674. For example, the ordering person inputs "OK" in the keyboard included in the manipulation input unit 120. Then, the control unit 190 judges that the confirmation result has no problem (NO). On the other hand, when the ordering person inputs "NG" and then inputs deficient content, the control unit 190 determines that there is a problem (YES).

When it is judged that there is a problem, that is, when the judgment in step S674 is NO, step S679 is executed. Specifically, the control unit 190 outputs the deficient content included in the confirmation result to the communication unit 130, and the communication unit 130 transmits the deficient content to the terminal device 200. Then, the procedure returns to step S672 and the communication unit 130 waits for the work completion report to be retransmitted from the terminal device 200.

On the other hand, when it is judged in step S674 that the confirmation result has no problem, that is, when the judgment in step S674 is YES, step S675 is executed. Specifically, the control unit 190 outputs an acceptance notification indicating that there is no problem in the work completion report to the communication unit 130, and the communication unit 130 transmits the acceptance notification to the terminal device 200. This process corresponds to the process of sequence S263.

Then, in step S681, the manipulation input unit 120 waits for an input manipulation for instructing the release of the safety measure by the ordering person who has confirmed safety based on the work completion report. When the manipulation input unit 120 receives the input manipulation for instructing the release of the safety measure, the manipulation input unit 120 outputs information indicating the received input manipulation to the control unit 190. This process corresponds to the process of sequence S265.

In steps S682 and S683, the control unit 190 judges whether the PIN lock for the safety measure as a release target has been released for all maintenance works by referencing the management data for safety measure stored in the storage unit 140, as described in sequences S262 to S274 (refer to FIG. 12).

When it is judged that there is a maintenance work for which the PIN lock has not been released, that is, when the judgment in step S683 is NO, the procedure returns to step S682 to wait for the PIN lock to be released in all maintenance works.

On the other hand, when it is judged in step S683 that the PIN lock is released in all the maintenance works, that is, when the judgment in step S683 is YES, step S684 is executed. Specifically, the control unit 190 controls the target device 900 to release the first state and enter a normal state according to the information output from the manipulation input unit 120. That is, the control unit 190 releases the safety measure. This process corresponds to the process of sequences S266 to S274 (refer to FIG. 12).

Then, in step S685, the control unit 190 detects that the safety measure has been released based on the information transmitted from the target device 900, and transmits information indicating that the safety measure has been released, to the terminal device 200 via the communication unit 130. This process corresponds to the process of sequence S275.

Further, in step S686, the control unit 190 displays that the safety measure has been released on the display unit 110. This process corresponds to the process of sequence S281.

Then, the process of FIG. 18 ends.

Next, operation of the terminal device 200 carried by the worker will be described with reference to FIGS. 19 to 23.

FIGS. 19 to 23 are flowcharts showing a process procedure performed by the terminal device 200.

Figure 19:
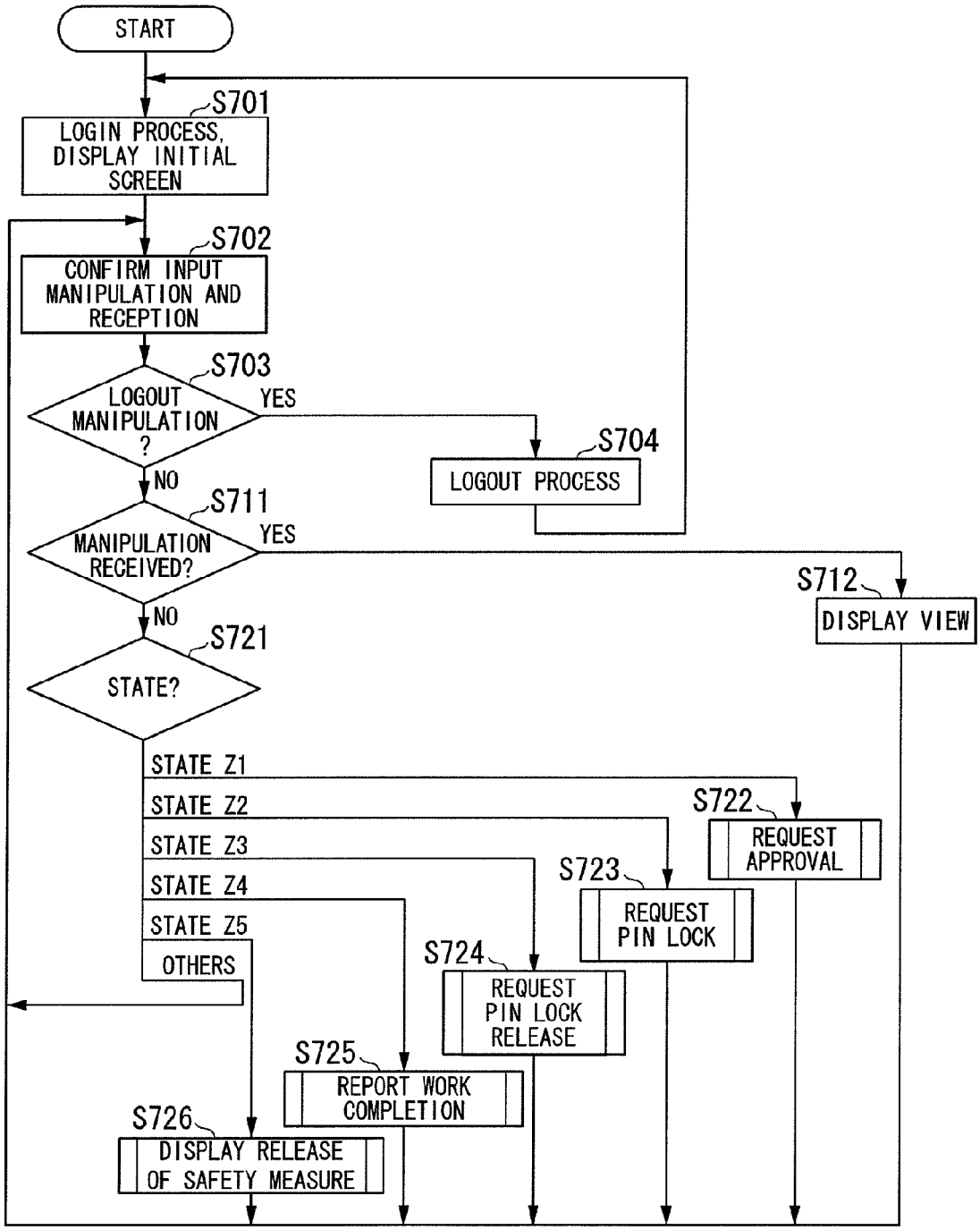
FIG. 19 is a flowchart showing a process procedure performed by the terminal device of the embodiment.

FIG. 19 is a flowchart showing an overview of a process procedure performed by the terminal device 200. The terminal device 200 performs the process of FIG. 19 when the power is ON.

First, in step S701, the terminal device 200 receives an ID and a password input from the worker to perform a login process, and displays an initial screen. This process corresponds to the process of sequences S111 to S112.

In step S702, the control unit 290 of the terminal device 200 confirms the presence or absence of an input manipulation by a worker in the manipulation input unit 220 and the presence or absence of a received radio signal in the communication unit 230.

In step S703, the control unit 290 judges whether the manipulation input unit 220 has received a logout manipulation. When the control unit 290 judges that the manipulation input unit 220 has received the logout manipulation, that is, when the judgment in step S703 is YES, step S704 is executed. Specifically, the control unit 290 performs a logout process, and the display unit 210 displays a login screen. Then, the procedure returns to step S701 to wait for the worker to login.

On the other hand, when the control unit 290 judges in step S703 that the manipulation input unit 220 has not received the logout manipulation, that is, when the judgment in step S703 is NO, step S711 is executed. Specifically, the control unit 290 judges whether the manipulation input unit 220 has received a manipulation for requesting information display. The manipulation for requesting information display cited herein is performed by the worker selecting an information display view such as the route map of the rail or the electrical power system view (touching a button on the screen) in the selection area A25 of the display screen in FIG. 3.

When the control unit 290 judges that a manipulation to request the information display is received, that is, when the judgment in step S711 is YES, step S712 is executed. Specifically, the control unit 290 controls the display unit 210 to display the requested view. Then, the procedure returns to step S702.

On the other hand, when the control unit 290 judges in step S711 that the manipulation input unit 220 has not received the manipulation for requesting information display, that is, when the judgment in step S711 is NO, step S721 is executed. Specifically, the control unit 290 judges a state of the maintenance work. The judgment of the state of the maintenance work is performed, for example, by the terminal device 200 querying the central control device 100 about the state of the maintenance work.

When the control unit 290 judges in step S721 that the state is a state Z1 in which the work order has been received and the approval request has not been transmitted, step S722 is executed. Specifically, the terminal device 200 performs a process of producing and transmitting the approval request and then the procedure returns to step S702.

When the control unit 290 judges in step S721 that the state is a state Z2 in which the approval request has been transmitted and PIN lock has not been performed, step S723 is executed. Specifically, the terminal device 200 performs a process of requesting the PIN lock and then the procedure returns to step S702.

When the control unit 290 judges in step S721 that the state is a state Z3 in which the PIN lock has been performed, step S724 is executed. Specifically, the terminal device 200 performs a process of requesting the release of the PIN lock and then the procedure returns to step S702.

When the control unit 290 judges in step S721 that the state is a state Z4 in which the work completion report has been requested, step S725 is executed. The terminal device 200 performs a process of producing and transmitting the work completion report and then the procedure returns to step S702.

When the control unit 290 judges in step S721 that the state is a state Z5 in which the information indicating that the safety measure has been released has been received, step S726 is executed. Specifically, the terminal device 200 controls the display unit 110 to display that the safety measure has been released and then the procedure returns to step S702.

On the other hand, when the control unit 290 judges in step S721 that the state is not any of the above-described states, the procedure returns to step S702. For example, this state corresponds to a state in which the work order has not been received.

Figure 20:
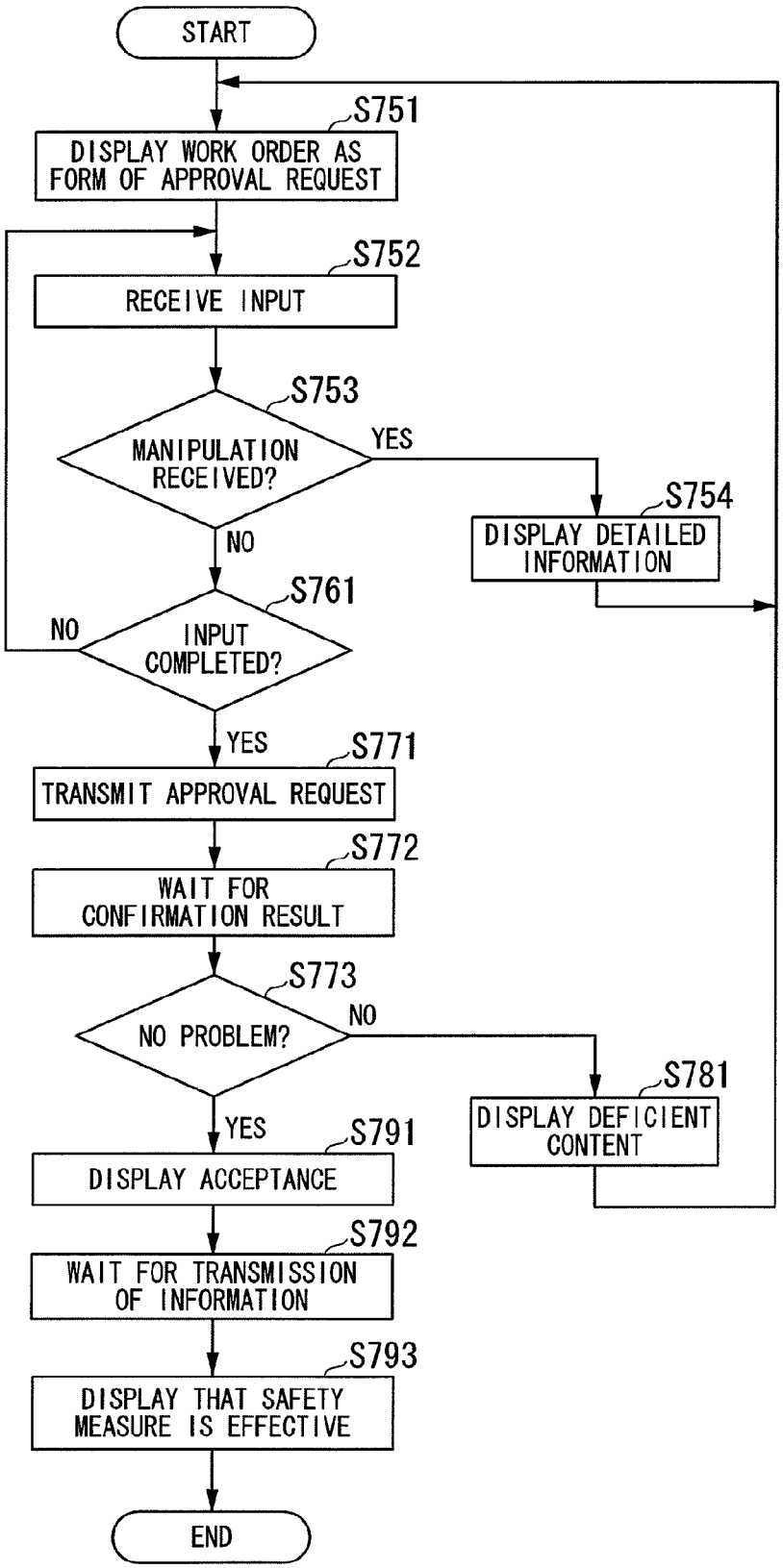
FIG. 20 is a flowchart showing a process procedure performed by the terminal device of the embodiment.

FIG. 20 is a flowchart showing a process procedure in which the terminal device 200 produces and transmits the approval request. The process in FIG. 20 is performed in step S722 (refer to FIG. 19).

First, in step S751, the control unit 290 displays the work order transmitted from the central control device 100, as a form of an approval request, on the display unit 210. This process corresponds to the process of sequence S122 (refer to FIG. 7).

Next, in step S752, the manipulation input unit 220 receives an input manipulation for requirements of the approval request. The control unit 290 produces the approval request based on the input received by the manipulation input unit 220. This process corresponds to the process of sequence S123.

Further, in step S753, the control unit 290 judges whether the manipulation input unit 220 has received a manipulation for instructing to display the detailed information of the maintenance work. When the control unit 290 receives an instruction to display the detailed information, that is, when the judgment in step S753 is YES, the procedure proceeds to step S754 and the control unit 290 displays the detailed information on the display unit 210 according to the instruction.

For example, when the worker wants a detailed procedure of the maintenance work while confirming the work order, the worker performs a manipulation for requesting display of a work manual or detailed data of a device that is a work target.

The terminal device 200 displays the work manual or the detailed data of the device, which is a work target, according to the manipulation. Further, the terminal device 200 may display information relating to the maintenance work, such as weather information of a work area.

The procedure then returns to step S751, in which the control unit 290 performs the process of continuing to create the approval request.

On the other hand, when the control unit 290 judges in step S753 that the manipulation input unit 220 has not received a manipulation for instructing to display the detailed information, that is, when the judgment in step S753 is NO, step S761 is executed. Specifically, the control unit 290 judges whether the input of requirements has been completed. For example, the control unit 290 judges whether the input of requirements has been completed based on whether the input completion button displayed by the display unit 110 has been pressed.

When the control unit 290 judges that the input of requirements has not been completed, that is, when the judgment in step S761 is NO, the procedure returns to step S752. The control unit 290 performs a process of continuing to create the approval request.

When the control unit 290 judges in step S761 that the input of requirements has been completed, that is, when the judgment in step S761 is YES, step S771 is executed. Specifically, the control unit 290 outputs the produced approval request to the communication unit 230. The communication unit 230 transmits the approval request to the central control device 100. This process corresponds to the process of sequence S124.

Then, in step S772, the communication unit 230 waits for the result of confirming the approval request to be transmitted from the central control device 100. When the communication unit 230 receives the confirmation result, the communication unit 230 outputs the confirmation result to the control unit 290.

In step S773, the control unit 290 judges whether there is a problem in the approval request according to the confirmation result. For example, the control unit 290 judges whether there is a problem based on whether the confirmation result is the acceptance notification transmitted in step S461 (refer to FIG. 15) or the deficient content transmitted in step S451.

When the control unit 290 judges that there is a problem, that is, when the judgment in step S773 is NO, step S781 is executed. The control unit 290 reads deficient content of the approval request from the confirmation result, and displays the read deficient content on the display unit 210. Then, the procedure returns to step S751 to perform a process of modifying the approval request.

When the control unit 290 judges that there is no problem, that is, when the judgment in step S773 is YES, step S791 is executed. Specifically, the control unit 290 controls the display unit 210 to display that the approval request has been accepted.

Then, in step S792, the communication unit 230 waits for information indicating that safety measure is made effective to be transmitted from the central control device 100. When the communication unit 230 receives the information, the communication unit 230 outputs the received information to the control unit 290. In step S793, the control unit 290 displays that the safety measure is made effective on the display unit 210 based on the information output from the communication unit 230. This process corresponds to the process of sequence S151 (refer to FIG. 7).

Then, the process in FIG. 20 ends and the procedure returns to step S702 (refer to FIG. 19).

Figure 21:
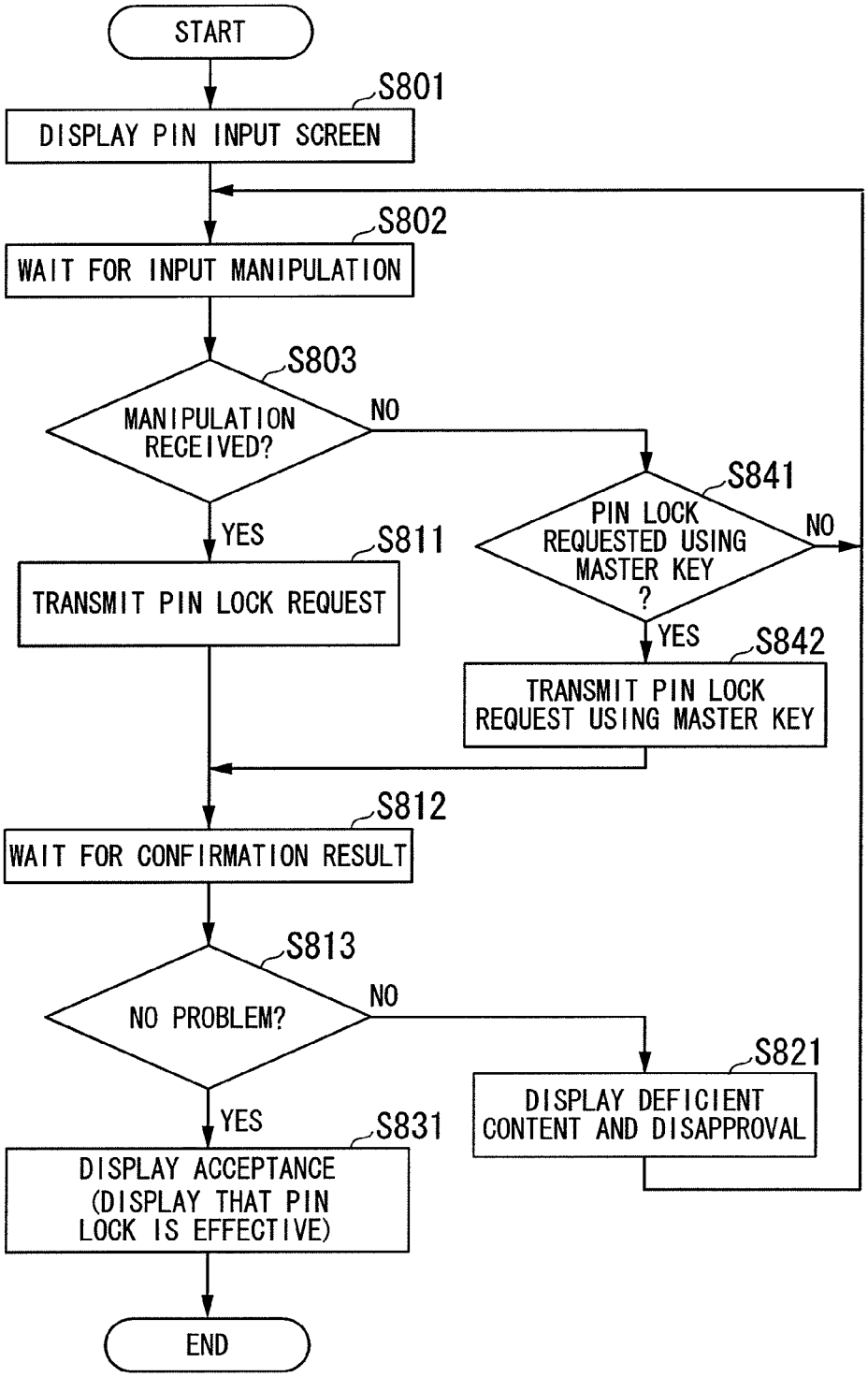
FIG. 21 is a flowchart showing a process procedure performed by the terminal device of the embodiment.

FIG. 21 is a flowchart showing a process procedure in which the terminal device 200 makes a request for PIN lock. The process in FIG. 21 is performed in step S723 (refer to FIG. 19).

First, in step S801, the control unit 290 controls the display unit 210 to display the PIN input screen in response to a request to display the PIN input screen, which is received by the manipulation input unit 220. This process corresponds to the process of sequence S161 (refer to FIG. 8).

Then, in step S802, the manipulation input unit 220 waits for an input manipulation and outputs information indicating the content of the received input manipulation to the control unit 290. This process corresponds to the process of sequence S162 (refer to FIG. 8).

In step S803, the control unit 290 judges whether the manipulation input unit 220 has received a PIN input manipulation and a manipulation for requesting the PIN lock.

When the control unit 290 judges that the manipulation input unit 220 has received these manipulations, that is, when the judgment in step S803 is YES, step S811 is executed. Specifically, the control unit 290 produces a request for PIN lock including the reference number corresponding to the work order and the PIN, and outputs the request for PIN lock to the communication unit 230. The communication unit 230 transmits the request for PIN lock to the central control device 100. This process corresponds to the process of sequence S163.

Then, the procedure proceeds to step S812.

On the other hand, in step S803, when the control unit 290 judges that the manipulation input unit 220 has not received the PIN input manipulation and the manipulation for requesting the PIN lock, that is, when the judgment in step S803 is NO, step S841 is executed. Specifically, the control unit 290 judges whether the manipulation input unit 220 has received a manipulation for pressing the mail transmission button as a manipulation for requesting the PIN lock using the master key. When it is judged that the manipulation for pressing a mail transmission button has been received, that is, when the judgment in step S841 is YES, step S842 is executed. Specifically, the control unit 290 provides the mail transmission means and creates E-mail according to a character input manipulation. When the manipulation input unit 220 receives the E-mail transmission manipulation, the control unit 290 transmits the E-mail to the central control device 100 via the communication unit 230.

This process corresponds to the process of sequence S183.

Then, the procedure proceeds to step S812.

On the other hand, when it is judged in step S841 that the manipulation for pressing a mail transmission button has not been received, that is, when the judgment in step S841 is NO, the procedure returns to step S802, in which the manipulation input unit 220 waits for the input manipulation.

In step S812, the communication unit 230 waits for the result of confirming the request for PIN lock.

After receiving the confirmation result, the communication unit 230 outputs the received confirmation result to the control unit 290.

In step S813, the control unit 290 judges whether there is no problem in the request for PIN lock based on the confirmation result. For example, the control unit 290 judges whether there is a problem based on whether the confirmation result is the information indicating that the PIN lock is made effective, which is transmitted in step S533 (refer to FIG. 16), or information of the deficient content transmitted in step S521.

When the control unit 290 judges that there is a problem, that is, when the judgment in step S813 is NO, step S821 is executed. Specifically, the control unit 290 reads deficient content of the request for PIN lock from the confirmation result and displays the read deficient content on the display unit 210. Then, the procedure returns to step S802, in which the manipulation input unit 220 waits for the input manipulation.

On the other hand, when the control unit 290 judges that there is a problem, that is, when the judgment in step S813 is YES, step S831 is executed. Specifically, the control unit 290 controls the display unit 210 to display that the PIN lock is made effective. This process corresponds to the process of sequence S168.

Then, the process of FIG. 21 ends and the procedure returns to step S702 (refer to FIG. 19).

Figure 22:
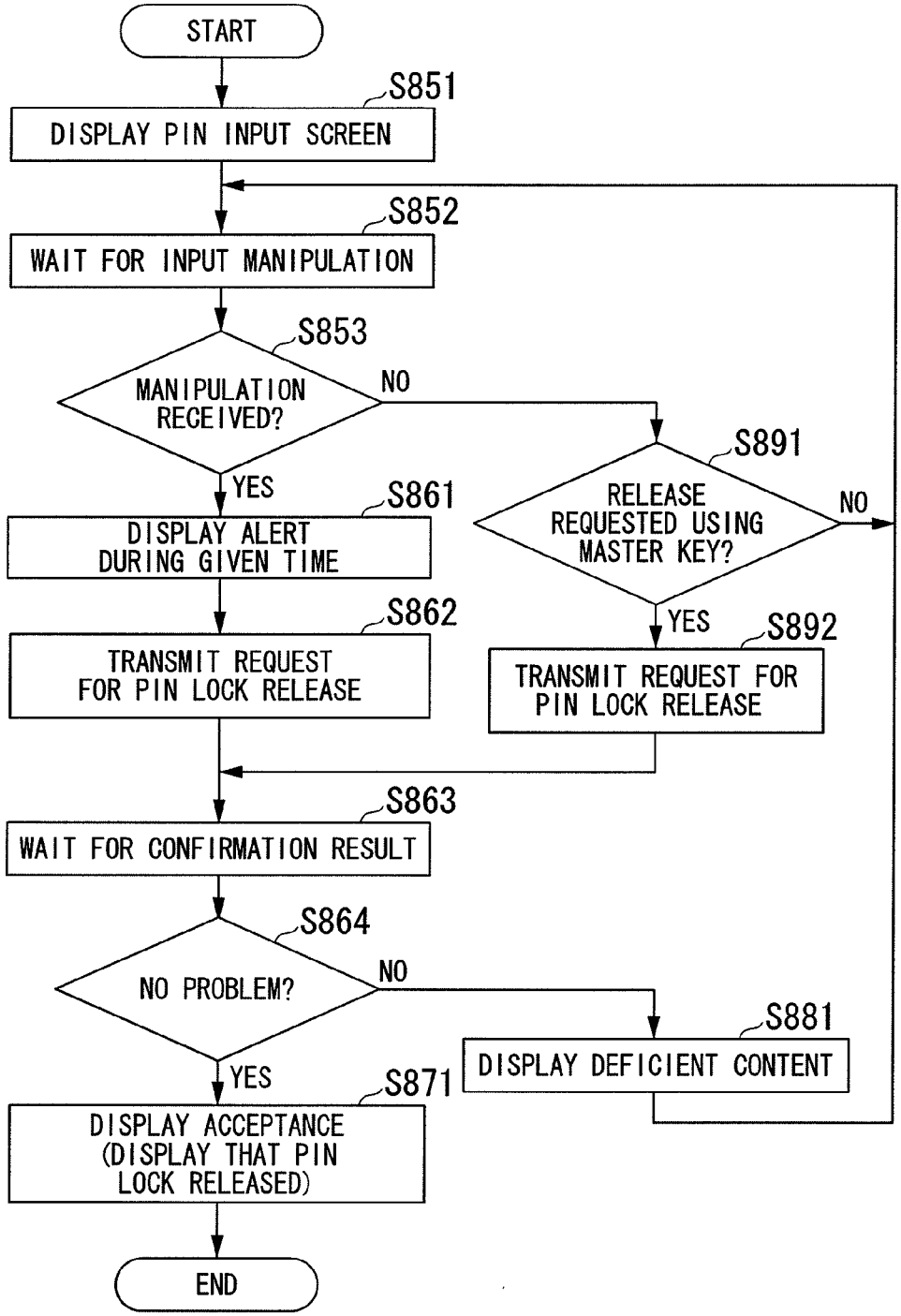
FIG. 22 is a flowchart showing a process procedure performed by the terminal device of the embodiment.

FIG. 22 is a flowchart showing a process procedure in which the terminal device 200 makes a release request. The process in FIG. 22 is performed in step S724 (refer to FIG. 19).

First, in step S851, the control unit 290 controls the display unit 210 to display the PIN input screen in response to a request to display the PIN input screen, which is received by the manipulation input unit 220. This process corresponds to the process of sequence S201 (refer to FIG. 10).

Then, in step S852, the manipulation input unit 220 waits for an input manipulation, and outputs information indicating content of the received input manipulation to the control unit 290. This process corresponds to the process of sequence S202.

In step S853, the control unit 290 judges whether the manipulation input unit 220 has received a PIN input manipulation and a release request manipulation.

When the control unit 290 judges that the manipulation input unit 220 has received these manipulations, that is, when the judgment in step S853 is YES, step S861 is executed. Specifically, the control unit 290 controls the display unit 210 to display an alert indicating that the safety measure may be released during a given time. This process corresponds to the process of sequence S203.

Then, in step S862, the control unit 290 generates a release request including the reference number corresponding to the work order and the PIN, and outputs the release request to the communication unit 230. The communication unit 230 transmits the release request to the central control device 100. This process corresponds to the process of sequence S204.

Then, the procedure proceeds to step S863.

In step S853, when it is judged that the manipulation input unit 220 has not received the PIN input manipulation and the manipulation for requesting PIN lock release, that is, when the judgment in step S853 is NO, step S891 is executed. Specifically, the control unit 290 judges whether the manipulation input unit 220 has received a manipulation for pressing the mail transmission button as a manipulation for a request for PIN lock release using a master key. When the control unit 290 judges that the manipulation for pressing the mail transmission button has been received, that is, when the judgment in step S891 is YES, step S892 is executed. Specifically, the control unit 290 provides a mail transmission means and produces E-mail according to a character input manipulation. When the manipulation input unit 220 receives a manipulation for transmitting the E-mail, the control unit 290 transmits the E-mail to the central control device 100 via the communication unit 230. This process corresponds to the process of sequence S223.

Then, the procedure proceeds to step S863.

On the other hand, in step S891, when it is judged that the manipulation for pressing a mail transmission button has not been received, that is, when the judgment in step S891 is NO, the procedure returns to step S852, in which the manipulation input unit 220 waits for the input manipulation.

In step S863, the communication unit 230 waits for the result of confirming the release request. After receiving the confirmation result, the communication unit 230 outputs the received confirmation result to the control unit 290.

In step S864, the control unit 290 judges whether there is no problem in the release request based on the confirmation result. For example, the control unit 290 judges whether there is a problem based on whether the confirmation result is the information indicating that the PIN lock has been released, which is transmitted in step S633 (refer to FIG. 17), or the information indicating the deficient content transmitted in step S621.

When the control unit 290 judges that there is a problem, that is, when the judgment in step S864 is NO, step S881 is executed. Specifically, the control unit 290 reads deficient content of the release request from the confirmation result, and displays the read deficient content on the display unit 210. Then, the procedure returns to step S852, and the manipulation input unit 220 waits for the input manipulation.

In step S864, when the control unit 290 judges that there is no problem, that is, when the judgment in step S864 is YES, step S871 is executed. Specifically, the control unit 290 controls the display unit 210 to display that the PIN lock has been released. This process corresponds to the process of sequence S209.

Then, the process of FIG. 22 ends and the procedure returns to step S702 (refer to FIG. 19).

Figure 23:
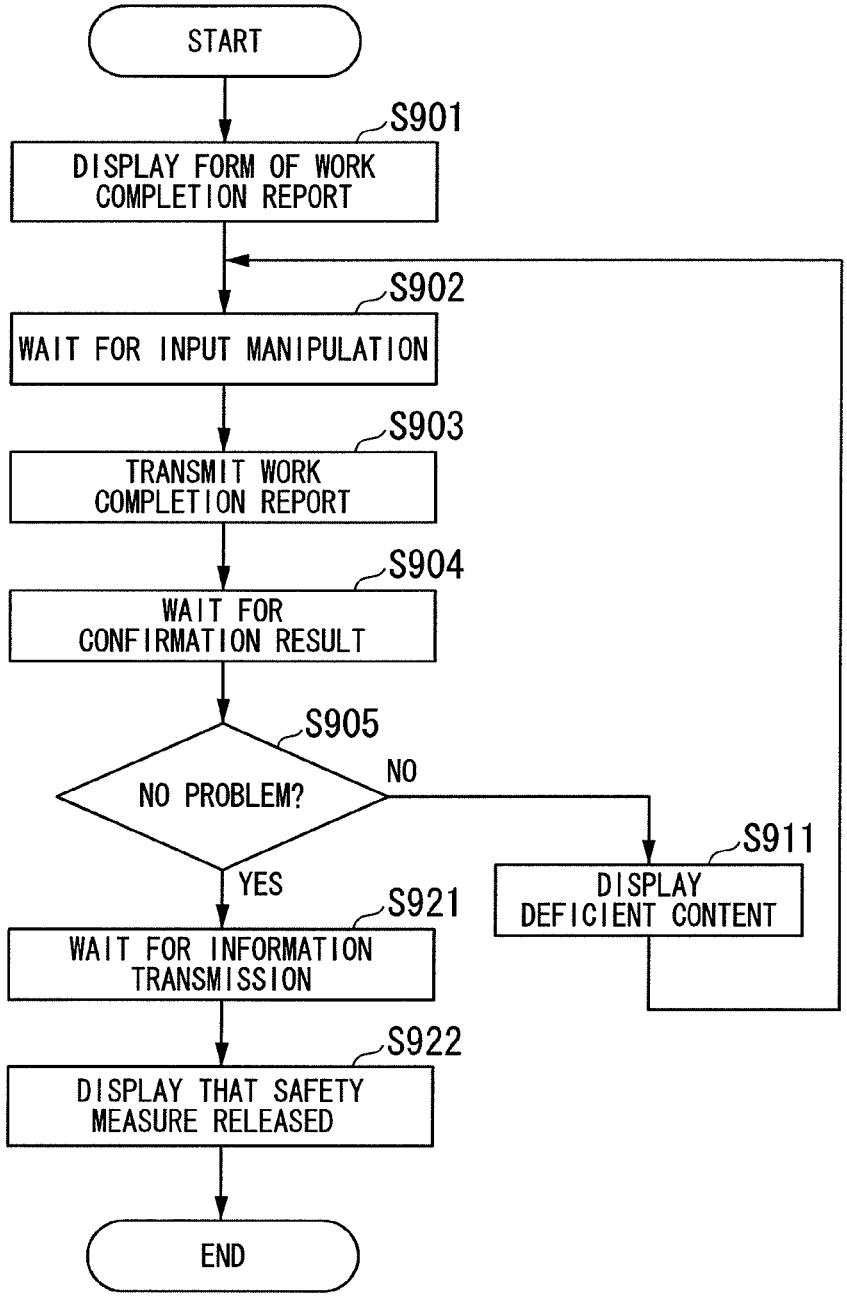
FIG. 23 is a flowchart showing a process procedure performed by the terminal device of the embodiment.

FIG. 23 is a flowchart showing a process procedure in which the terminal device 200 produces and transmits a work completion report. The process in FIG. 23 is performed in step S725 (refer to FIG. 19).

First, in step S901, according to a manipulation for requesting to display a form for reporting work completion, which is received by the manipulation input unit 220, the control unit 290 reads the form for reporting the work completion which is stored in the storage unit 240 in advance. The control unit 290 controls the display unit 210 to display the form for reporting the work completion. This process corresponds to the process of sequence S210 (refer to FIG. 10) or S231 (refer to FIG. 11).

In step S902, the manipulation input unit 220 waits for a manipulation for inputting requirements to the form for reporting the work completion, and outputs the input requirements to the control unit 290.

The control unit 290 produces a work completion report according to the requirements output from the manipulation input unit 220. When the manipulation input unit 220 receives a manipulation for transmitting the work completion report, the control unit 290 transmits the produced work completion report to the central control device 100 via the communication unit 230 in step S903.

Then, in step S904, the communication unit 230 waits for the result of confirming the work completion report. After receiving the confirmation result, the communication unit 230 outputs the received confirmation result to the control unit 290.

In step S905, the control unit 290 judges whether there is no problem in the release request based on the confirmation result. For example, the control unit 290 judges whether there is a problem based on whether the confirmation result is the acceptance notification transmitted in step S675 (refer to FIG. 18) or the deficient content transmitted in step S679.

When the control unit 290 judges that there is a problem, that is, when the judgment in step S905 is NO, step S911 is executed. Specifically, the control unit 290 reads deficient content of the release request from the confirmation result, and displays the read deficient content on the display unit 210. Then, the procedure returns to step S902, in which the manipulation input unit 220 waits for an input manipulation.

When the control unit 290 judges that there is no problem, that is, when the judgment in step S773 is YES, the communication unit 230 waits for information indicating that the safety measure has been released in step S921. When the communication unit 230 receives the information, the control unit 290 displays that the safety measure has been released on the display unit 210 according to the information in step S922.

Then, the process in FIG. 23 ends and the procedure returns to step S702 (refer to FIG. 19).

As described above, the central control device 100 transitions to the PIN lock state in which the first state is maintained, in response to the request from the terminal device 200. When the central control device 100 transitions to the PIN lock state, the terminal device 200 displays that the PIN lock is made effective.

Accordingly, when there is no request from the terminal device 200, that is, when there is no request by the worker, the central control device 100, in principle, cannot release the safety measure, which is displayed on the terminal device 200. Therefore, it is possible to prevent the worker from being in danger due to the release of the safety measure caused by erroneous situation recognition or faulty manipulation by the ordering person in the operation control center. That is, it is possible to reduce possibility of the worker being in danger.

Since the worker can confirm that the safety measure is maintained, it is possible to reduce the anxiety of the worker. Further, the worker confirms that the safety measure is maintained and then can initiate the maintenance work. Therefore, the safety measure is not executed by erroneous situation recognition or faulty manipulation by the ordering person, thereby preventing the worker from being in danger.

Further, both the central control device 100 and the terminal device 200 display information on the control state of the target device 900, such as information indicating that the PIN lock has been performed. This enables both the ordering person and the worker to confirm the control state of the target device 900.

Further, the central control device 100 can perform the PIN lock by receiving the request for PIN lock using the master key even in a state in which communication is not possible due to failure or battery shortage of the terminal device 200 or poor radio conditions, or when a authorized person making a request for PIN lock is absent. Accordingly, it is possible to reduce anxiety of the worker or possibility of the worker being in danger.

Further, the central control device 100 can release the PIN lock by receiving the request for PIN lock release using a master key, even in a state in which communication is not possible due to failure or battery shortage of the terminal device 200 or poor radio conditions, or when a authorized person making a release request is absent. It is possible to restore the rail transportation control system 1 by releasing the safety measure according to the release of the PIN lock.

Further, the central control device 100 controls the target device 900 to enter the first state based on the approval request transmitted from the terminal device 200 (the information indicating that the instruction has been confirmed). Thus, the worker can take a safety measure in a state in which the worker understands the maintenance work. Accordingly, the maintenance work is rapidly performed, such that the safety measure can be released in a relatively short time to restore the rail transportation control system.

The terminal device 200 transmits a request for PIN lock in the first state. That is, only when the PIN lock is possible, does the terminal device 200 timely transmit the request for PIN lock. Therefore, it is possible to suppress transmission of a request for useless PIN lock and suppress power consumption of the terminal device 200.

The central control device 100 judges whether the request for PIN lock is from a person having a right to make a request for PIN lock based on the PIN included in the request for PIN lock. Therefore, it is possible to prevent an illegal request for PIN lock from a person having no right to make such a request.

The central control device 100 releases the PIN lock based on the request for PIN lock release from the terminal device 200 carried by the worker. That is, when there is no request for PIN lock release from the terminal device 200 carried by the worker, the central control device 100 does not release the PIN lock in principle. Therefore, it is possible to prevent the PIN lock from being released and the safety measure from being released due to erroneous recognition or faulty manipulation by the ordering person in the operation control center, thereby securing the safety of the worker.

The central control device 100 judges whether the release request is from a person having a right to make a release request based on the PIN included in the request for PIN lock release. Thereby, it is possible to prevent an illegal release request from a person having no right and to secure the safety of the worker more reliably.

Also, a program for realizing all or some of the functions of the central control device 100 or the terminal device 200 may be recorded in a computer-readable recording medium. The program recorded in this recording medium may be read and executed with a computer system to perform a process of each unit. Also, the "computer system" cited herein includes an OS or software of a peripheral device and the like.

Further, when using a WWW system, the "computer system" includes an environment provided by a homepage (or an environment in which a homepage is displayed).

Further, the "computer-readable recording medium" includes a storage unit, including a portable medium such as a flexible disk, a magnetic optical disc, a ROM, or a CD-ROM, and a hard disk embedded in the computer system. Further, the "computer-readable recording medium" includes the following (1) and (2). (1) A medium for temporarily and dynamically storing programs, like a communication line when a program is transmitted via a network such as the Internet or a communication line such as a telephone line. (2) A medium for storing programs for a given time, like a volatile memory inside a computer system consisting of a server and a client in that case. The program may be a program for realizing some of the above-described functions. Alternatively, the program may be a program capable of realizing the above-described functions through a combination with a program previously stored in a computer system.

Embodiments of the present invention include the following (1) to (12).

(1) A control system having the following configuration. A target device has an influence on the safety of the maintenance work. A control device including a control unit for controlling the target device to enter a maintenance-allowed state (first state) in which the maintenance work is safely performed, and a communication unit (first communication unit) for performing communication. A maintenance worker terminal device (terminal device) including a manipulation input unit (a first input unit) for receiving an input manipulation by a maintenance worker (worker) performing the maintenance work; a lock request generation unit (a request generation unit) for generating a lock request to request the control device to maintain the maintenance-allowed state in response to an input manipulation received by the manipulation input unit when the control unit of the control device controls the target device to enter the maintenance-allowed state; and a communication unit (a second communication unit) for performing communication.

In this control system, the communication unit of the maintenance worker terminal device transmits the lock request. The communication unit of the control device receives the lock request. The control unit of the control device transitions to a lock state in which the control unit controls the target device to maintain the maintenance-allowed state, based on the lock request received by the communication unit of the control device.

(2) In the control system described in (1), the control device includes a manipulation input unit (a second input unit) for receiving an input manipulation. The communication unit of the control device transmits a work instruction indicating content of the maintenance work to the maintenance worker terminal device according to the input manipulation received by the manipulation input unit of the control device. After receiving the work instruction, the communication unit of the maintenance worker terminal device transmits instruction confirmation completion information indicating that the maintenance worker has confirmed the work instruction to the control unit according to the input manipulation received by the manipulation input unit of the maintenance worker terminal device. The control unit of the control device controls the target device to enter the maintenance-allowed state based on the instruction confirmation completion information transmitted from the maintenance worker terminal device.

(3) In the control system described in (1) or (2), when the control unit controls the target device to enter the maintenance-allowed state, the communication unit of the control device transmits information indicating that the target device has entered the maintenance-allowed state to the maintenance worker terminal device. After receiving information indicating that the target device has entered the maintenance-allowed state, the communication unit of the maintenance worker terminal device transmits the lock request to the control device according to the input manipulation received by the manipulation input unit of the maintenance worker terminal device. The control unit of the control device transitions to the lock state based on the lock request transmitted from the maintenance worker terminal device.

(4) In the control system described in any one of (1) to (3), the manipulation input unit of the maintenance worker terminal device receives a lock request manipulation including PIN code for identifying the maintenance worker (personal identification code). The communication unit of the maintenance worker terminal device transmits the lock request including the PIN code. The control unit of the control device transitions to the lock state when judging that the PIN code included in the lock request is coincident with a previously registered PIN code.

(5) In the control system described in any one of (1) to (4), the communication unit of the control device and the communication unit of the maintenance worker terminal device perform wireless communication.

(6) In the control system described in any one of (1) to (5), after receiving the lock request, the communication unit of the maintenance worker terminal device transmits a lock release request to request release of the lock state according to the input manipulation received by the manipulation input unit of the maintenance worker terminal device. The control unit of the control device releases the lock state based on the lock release request.

(7) In the control system described in any one of (1) to (6), the manipulation input unit of the maintenance worker terminal device receives a lock release request manipulation including an input of a PIN code for identifying the maintenance worker. The communication unit of the maintenance worker terminal device transmits the lock release request including the PIN code. The control unit of the control device releases the lock state when it determines that the PIN code included in the lock release request is coincident with a previously registered PIN code.

(8) In the control system described in (1), the control device includes a manipulation input unit for receiving an input manipulation. The control unit releases the lock state based on the input manipulation received by the manipulation input unit of the control device.

(9) A maintenance worker terminal device including the following configuration. A communication unit for receiving information indicating that a control device controls a target device having an influence on the safety of maintenance work to enter a maintenance-allowed state in which the maintenance work is safely performed. An input unit for receiving an input manipulation. In the maintenance worker terminal device, the communication unit transmits a lock request to the control device to request the control device to maintain the maintenance-allowed state in response to the input manipulation received by the input unit, after receiving the information.

(10) In the maintenance worker terminal device described in (9), after receiving the lock request, the communication unit transmits a lock release request to the control device to request release of the lock state according to the input manipulation received by the manipulation input unit.

(11) A control device including the following configuration. A control unit for controlling a target device having an influence on safety of maintenance work to enter a maintenance-allowed state in which the maintenance work is safely performed. A communication unit for receiving a lock request to request to maintain the maintenance-allowed state. In this control device, when controlling the target device to enter the maintenance-allowed state, the control unit transitions to a lock state in which the control unit controls the target device to maintain the maintenance-allowed state when the communication unit receives the lock request.

(12) In the control device described in (11), the communication unit receives a lock release request to request release of the lock state. From the lock state, the control unit releases the lock state based on the lock release request when the communication unit receives the lock release request.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A control system comprising:

a target device having an influence on safety of maintenance work;

a control device for controlling the target device; and a terminal device manipulated by a worker performing the maintenance work, wherein the control device includes (i) a control unit for controlling the target device to enter a first state in which the worker is allowed to safely perform the maintenance work and (ii) a first communication unit for performing communication with the terminal device and for transmitting second information, indicating that the target device has entered the first state, to the terminal device, the terminal device includes (i) a first input unit for receiving an input manipulation by the worker, (ii) a request generation unit for generating a request directed to the control device, and (iii) a second communication unit for performing communication with the control device and for receiving the second information, after the second communication unit receives the second information, (i) the request generation unit generates a lock request to maintain the first state in response to the input manipulation and (ii) the second communication unit transmits the lock request, the first communication unit receives the lock request, the control unit transitions to a lock state in which the control unit controls the target device to maintain the first state, based on the lock request received by the first communication unit, the first communication unit transmits lock information specifying that the target device is maintained in the first state by the control unit, the second communication unit receives the lock information, after transmitting the lock request, the second communication unit transmits a release request to request release of the lock state according to the input manipulation received by the first input unit, the control unit releases the lock state based on the release request, the first communication unit transmits release information specifying that the lock state is released by the control unit, and the second communication unit receives the release information.

2. The control system according to claim 1, wherein the control device includes a second input unit for receiving an input manipulation by a worker, the first communication unit transmits a work instruction indicating content of the maintenance work to the second communication unit according to the input manipulation received by the second input unit, after receiving the work instruction, the second communication unit transmits first information indicating that the worker has confirmed the work instruction to the control unit according to the input manipulation received by the first input unit, and the control unit controls the target device to enter the first state based on the first information transmitted from the second communication unit.

3. The control system according to claim 1, wherein the first input unit receives an input manipulation for a lock request including a personal identification code for identifying the worker, the second communication unit transmits the lock request including the personal identification code, and the control unit transitions to the lock state when judging that the personal identification code included in the lock request is coincident with a previously registered personal identification code.

4. The control system according to claim 1, wherein the first communication unit and the second communication unit perform wireless communication.

5. The control system according to claim 1, wherein the first input unit receives an input manipulation for a release request including an input of a personal identification code for identifying the worker, the second communication unit transmits the release request including the personal identification code to the control unit, and the control unit releases the lock state based on the release request when judging that the personal identification code included in the release request is coincident with a previously registered personal identification code.

6. A control system comprising:

a target device having an influence on safety of maintenance work;

a control device for controlling the target device; and a terminal device manipulated by a worker performing the maintenance work, wherein the control device includes (i) a control unit for controlling the target device to enter a first state in which the worker is allowed to safely perform the maintenance work, (ii) a first communication unit for performing communication with the terminal device and for transmitting second information, indicating that the target device has entered the first state, to the terminal device, and (iii) a second input unit for receiving an input manipulation by the worker, the terminal device includes (i) a first input for receiving an input manipulation by the worker, (ii) a request generation unit for generating a request directed to the control device, and (iii) a second communication unit for performing communication with the control device and for receiving the second information, after the second communication unit received the second information, (i) the request generation unit generates a lock request to maintain the first state in response to the input manipulation and (ii) the second communication unit transmits the lock request, the first communication unit receives the lock request, the control unit transitions to a lock state in which the control unit controls the target device to maintain the first state, based on the lock request received by the first communication unit, the first communication unit transmits the lock information specifying that the target device is maintained in the first state by the control unit, the second communication unit receives the lock information, the control unit releases the lock state based on the input manipulation received by the second input unit, the first communication unit transmits release information specifying that the lock state is released by the control unit, and the second communication unit receives the release information.

7. A terminal device comprising:

a communication unit for receiving information of a control device for controlling a target device having an influence on safety of maintenance work;

an input unit for receiving an input manipulation; and a request generation unit which generates a request directed to the control device, wherein after the communication unit receives information indicating that the control device has controlled the target device to enter a first state in which the maintenance work is safely performed, (i) the request generation unit generates a lock request to maintain the first state in response to the input manipulation received by the input unit and (ii) the communication unit transmits the lock request to the control device, the communication unit receives lock information specifying that the target device is maintained in the first state by the control device from the control device, and after transmitting the lock request, the communication unit (i) transmits a release request to the control device to request release of the lock state according to the input manipulation received by the input unit, (ii) receives release information specifying that the lock state is released by the control device from the control device, and (iii) after receiving the release information, transmits a work completion report generated based on the input manipulation received by the input unit to the control device.

8. A control device comprising:

a control unit for controlling a target device having an influence on safety of maintenance work to enter a first state in which the maintenance work is safely performed; and a communication unit for receiving, from a terminal device, a lock request requesting that the first state be maintained, wherein the communication unit transmits information, indicating that the target device has entered the first state, to the terminal device, after the terminal device receives the information, the control unit transitions to a lock state in which the control unit controls the target device to maintain the first state when the communication unit receives the lock request from the terminal device, the communication unit (i) transmits lock information specifying that the target device is maintained in the first state by the control unit to the terminal device and (ii) receives a release request to request release of the lock state from the terminal device, the control unit releases the lock state based on the release request when the communication unit receives the release request, and the communication unit transmits release information specifying that the lock state is released by the control unit to the terminal device.

* * * * *